US012185829B2

(12) United States Patent
Xie et al.

(10) Patent No.: US 12,185,829 B2
(45) Date of Patent: Jan. 7, 2025

(54) ORAL CARE IMPLEMENT

(71) Applicant: Colgate-Palmolive Company, New York, NY (US)

(72) Inventors: Fan Gang Xie, Shanghai (CN); Wen Jin Xi, Shanghai (CN); Yanmei Ji, Jiangsu (CN); Jiang Zhou, Yangzhou (CN); Douglas Hohlbein, Hopewell, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 17/582,310

(22) Filed: Jan. 24, 2022

(65) Prior Publication Data

US 2022/0142348 A1 May 12, 2022

Related U.S. Application Data

(63) Continuation of application No. 16/616,187, filed as application No. PCT/CN2018/120838 on Dec. 13, 2018, now Pat. No. 11,266,226.

(51) Int. Cl.

| | |
|---|---|
| ***A46B 9/04*** | (2006.01) |
| ***A46B 9/02*** | (2006.01) |
| ***A46D 1/00*** | (2006.01) |

(52) U.S. Cl.

CPC ..... *A46B 9/04* (2013.01); *A46B 9/028* (2013.01); *A46D 1/0276* (2013.01); *A46D 1/0284* (2013.01); *A46B 2200/1066* (2013.01)

(58) Field of Classification Search

CPC ... A46B 9/04; A46B 9/028; A46B 2200/1066; A46D 1/0276; A46D 1/0284

See application file for complete search history.

(56) References Cited

U.S. PATENT DOCUMENTS

| | | | |
|---|---|---|---|
| 1,364,971 | A | 1/1921 | Alexander |
| 1,559,114 | A | 10/1925 | Maranville |

(Continued)

FOREIGN PATENT DOCUMENTS

| | | |
|---|---|---|
| AU | 2012203910 | 7/2012 |
| BR | 6805219-7 | 3/2009 |

(Continued)

OTHER PUBLICATIONS

Machine translation of JP-2000004945-A to Endo et al. (Year: 2000).*

(Continued)

*Primary Examiner* — Steven M Cernoch
*Assistant Examiner* — Jonathan R Zaworski

(57) ABSTRACT

An oral care implement having a head with a bristle bearing surface. The oral care implement may include a central bristle tuft extending from a central portion of the bristle bearing surface, the central bristle tuft terminating in a domed distal surface. Furthermore, the oral care implement may include a plurality of perimetric bristle tufts extending from the bristle bearing surface and arranged to circumferentially surround the central bristle tuft. Each of the perimetric bristle tufts may have an inclined distal surface that slopes downward towards the central bristle tuft. The bristle bearing surface of the head may have a total surface area (TSA), and the toothbrush may include a tooth cleaning element field having X number of tooth cleaning elements that collectively occupy a total cleaning element area (TCEA) such that $$\frac{1}{X} \times \frac{TCEA}{TSA} = Z$$

and Z is in a range of 0.04 to 0.065.

13 Claims, 10 Drawing Sheets

(56) References Cited

U.S. PATENT DOCUMENTS 2,040,245 A 5/1936 Crawford
2,043,898 A 6/1936 Malcolm
D144,163 S 3/1946 Dolnick
2,797,424 A 7/1957 Olson
3,295,156 A 1/1967 Brant
3,934,298 A 1/1976 Kim
D278,661 S 5/1985 Gelsen
4,979,782 A 12/1990 Werk
5,380,202 A 1/1995 Brahler
5,392,483 A 2/1995 Heinzelman et al.
D357,121 S 4/1995 Fuentes et al.
5,533,227 A 7/1996 Ito et al.
5,535,474 A 7/1996 Salazar
5,655,249 A 8/1997 Li
D387,205 S 12/1997 Moskovich
D397,872 S 9/1998 Moskovich et al.
D404,205 S 1/1999 Hohlbein
D427,437 S 7/2000 Vonarburg
D441,958 S 5/2001 Rueb
6,260,227 B1 7/2001 Fulop et al.
D446,393 S 8/2001 Manfredi et al.
D456,136 S 4/2002 Roehrig
6,421,867 B1 7/2002 Weihrauch
6,438,786 B2 8/2002 Harada
D462,527 S 9/2002 Ping
D471,363 S 3/2003 Grau et al.
6,546,586 B2 4/2003 Cho
D475,529 S 6/2003 Wright et al.
D475,531 S 6/2003 Klimeck et al.
D476,156 S 6/2003 Ferber et al.
D476,487 S 7/2003 Saindon et al.
D479,914 S 9/2003 Choong
D480,213 S 10/2003 Ping
D480,214 S 10/2003 Kling et al.
D490,613 S 6/2004 Wong
D494,370 S 8/2004 Wong
D510,807 S 10/2005 Jimenez
D513,126 S 12/2005 Jimenez et al.
D513,882 S 1/2006 Hohlbein et al.
D517,812 S 3/2006 Hohlbein et al.
7,047,591 B2 5/2006 Hohlbein
D527,907 S 9/2006 Kling et al.
7,213,288 B2 5/2007 Hohlbein
D558,980 S 1/2008 Jimenez et al.
D577,493 S 9/2008 Wong
7,458,125 B2 12/2008 Hohlbein et al.
D590,597 S 4/2009 Geiberger
D599,555 S 9/2009 Oliphant
D615,761 S 5/2010 Wong
D619,717 S 7/2010 Toshima
7,788,756 B2 9/2010 Kraemer
7,814,603 B2 10/2010 Gavney, Jr.
7,841,041 B2 11/2010 Moskovich et al.
D630,020 S 1/2011 Wong
D634,934 S 3/2011 Kalbfeld et al.
7,899,905 B2 3/2011 Rahman et al.
D635,775 S 4/2011 Kalbfeld et al.
8,006,342 B2 8/2011 Nanda
D645,254 S 9/2011 Xi et al.
D654,270 S 2/2012 Jimenez et al.
D654,695 S 2/2012 Jimenez et al.
D654,696 S 2/2012 Jimenez et al.
8,108,962 B2 2/2012 Davidson et al.
8,151,397 B2 4/2012 Moskovich et al.
D661,100 S 6/2012 Nanda
D661,490 S 6/2012 Jin et al.
D664,359 S 7/2012 Xi et al.
D666,005 S 8/2012 Winkler
D671,326 S 11/2012 Jimenez et al.
D672,561 S 12/2012 Jin et al.
D674,609 S 1/2013 Li
D675,830 S 2/2013 Jimenez et al.
D675,831 S 2/2013 Xi
8,387,196 B2 * 3/2013 Jimenez ..... A46B 9/04 15/207.2
8,464,388 B2 6/2013 Chen
D686,825 S 7/2013 Xi et al.
8,499,401 B2 8/2013 Davidson et al.
8,511,323 B2 8/2013 Jimenez et al.
D692,242 S 10/2013 Jimenez et al.
8,549,691 B2 10/2013 Moskovich et al.
D698,554 S 2/2014 Xi et al.
D704,447 S 5/2014 Xi et al.
D706,036 S 6/2014 Xi et al.
8,777,615 B2 7/2014 Hayman et al.
8,784,102 B1 7/2014 Kumar
D710,111 S 8/2014 Ding et al.
8,800,093 B2 8/2014 Moskovich et al.
8,813,292 B2 8/2014 Priesen et al.
8,813,296 B2 8/2014 Moskovich et al.
8,839,481 B2 9/2014 Moskovich et al.
9,033,899 B2 5/2015 Gatzemeyer et al.
9,066,579 B2 6/2015 Hess et al.
9,655,435 B2 6/2015 Hess et al.
D734,614 S 7/2015 Driesen et al.
9,125,484 B2 9/2015 Gatzemeyer
D747,609 S 1/2016 Watkins
D751,295 S 3/2016 Lee et al.
D759,380 S 6/2016 Watkins
D764,176 S 8/2016 Xi et al.
D764,177 S 8/2016 Xi et al.
D765,983 S 9/2016 Jimenez et al.
D776,436 S 1/2017 Xi
D777,446 S 1/2017 Xi et al.
9,572,417 B2 2/2017 Hess et al.
D780,457 S 3/2017 Jimenez et al.
D780,459 S 3/2017 Xi et al.
D783,290 S 4/2017 Lee et al.
D793,736 S 8/2017 Zavalloni
D795,419 S 8/2017 Kohler
D798,061 S 9/2017 Jimenez
9,826,822 B2 11/2017 Geiberger et al.
D813,550 S 3/2018 Xi et al.
D814,796 S 4/2018 Xi et al.
9,955,778 B2 5/2018 Xi et al.
10,004,322 B2 6/2018 Jungnickel et al.
D824,174 S 7/2018 Altmann et al.
10,039,370 B2 8/2018 Lee et al.
D833,756 S 11/2018 Hielscher et al.
D833,757 S 11/2018 Hielscher et al.
D834,325 S 11/2018 Hielscher et al.
10,172,440 B2 1/2019 Wagstaff
10,178,907 B2 1/2019 Hohlbein
10,206,492 B2 2/2019 Gottlieb
10,238,204 B2 3/2019 Lee et al.
D849,408 S 5/2019 Bloch et al.
D851,411 S 6/2019 Wainless et al.
10,314,387 B2 6/2019 Jungnickel et al.
D854,332 S 7/2019 Hielscher et al.
D854,336 S 7/2019 Hielscher et al.
D854,835 S 7/2019 Hielscher et al.
D855,998 S 8/2019 Hielscher et al.
D860,653 S 9/2019 Xi et al.
10,426,250 B2 10/2019 Jimenez et al.
10,485,328 B2 11/2019 Jimenez et al.
D868,479 S * 12/2019 Papazian ..... D4/101
D868,480 S * 12/2019 Papazian ..... D4/104
D868,481 S 12/2019 Papazian
D868,483 S 12/2019 Papazian
D869,852 S 12/2019 Papazian
D869,853 S 12/2019 Papazian
10,548,393 B2 * 2/2020 Xi ..... A46B 9/04
D877,519 S 3/2020 Xi et al.
10,582,761 B2 3/2020 Jimenez et al.
10,595,628 B2 3/2020 Jimenez et al.
D880,164 S 4/2020 Zavalloni
D881,580 S 4/2020 Smigel
D882,271 S 4/2020 Mote
D883,677 S 5/2020 Xie et al.
D884,353 S 5/2020 Xi et al.
D886,460 S 6/2020 Xi et al.
D887,145 S 6/2020 Hu
10,687,925 B2 6/2020 Störkel et al.
10,743,645 B2 8/2020 Lee et al.

(56) References Cited

U.S. PATENT DOCUMENTS

| | | | | |
|---|---|---|---|---|
| D894,612 | S | 9/2020 | Zhang | |
| D901,183 | S | 11/2020 | Jungnickel et al. | |
| D902,600 | S | 11/2020 | Altmann et al. | |
| 10,849,416 | B2 | 12/2020 | Hohlbein | |
| 10,874,204 | B2 * | 12/2020 | Langenegger | A46B 9/028 |
| D919,301 | S | 5/2021 | Zhao | |
| 11,013,313 | B2 | 5/2021 | Xi et al. | |
| 11,033,096 | B2 | 6/2021 | Bloch et al. | |
| 11,103,057 | B2 | 8/2021 | Pillai et al. | |
| D932,190 | S | 10/2021 | Kraemer | |
| D933,368 | S | 10/2021 | Albay et al. | |
| D935,187 | S | 11/2021 | Hu | |
| D935,188 | S | 11/2021 | He et al. | |
| 11,224,282 | B2 | 1/2022 | Wong et al. | |
| D943,283 | S | 2/2022 | Xie et al. | |
| D946,901 | S | 3/2022 | Matelo | |
| 11,266,226 | B2 | 3/2022 | Xie et al. | |
| D950,249 | S | 5/2022 | Albay et al. | |
| D950,960 | S | 5/2022 | Wainless | |
| D953,039 | S | 5/2022 | Altmann et al. | |
| D953,744 | S | 6/2022 | Altmann et al. | |
| D959,843 | S | 8/2022 | Jungnickel et al. | |
| D960,583 | S | 8/2022 | Hallein et al. | |
| D961,269 | S | 8/2022 | Xie et al. | |
| D961,270 | S | 8/2022 | Jimenez | |
| D965,984 | S | 10/2022 | Lee | |
| D968,814 | S | 11/2022 | Tang | |
| D972,846 | S | 12/2022 | Altmann et al. | |
| D976,010 | S | 1/2023 | Jungnickel | |
| D984,136 | S | 4/2023 | Albay et al. | |
| D987,298 | S | 5/2023 | Xi | |
| D989,491 | S | 6/2023 | Lovegrove | |
| D989,492 | S | 6/2023 | Cu et al. | |
| D991,684 | S | 7/2023 | Holley | |
| D993,632 | S | 8/2023 | Cu | |
| D1,011,762 | S | 1/2024 | Blachford | |
| D1,023,582 | S | 4/2024 | Xie | |
| D1,023,583 | S | 4/2024 | Nanda | |
| D1,024,571 | S | 4/2024 | Xie et al. | |
| D1,024,572 | S | 4/2024 | Wang | |
| D1,024,573 | S | 4/2024 | Xie | |
| D1,026,470 | S | 5/2024 | Xie | |
| D1,029,506 | S | 6/2024 | Jimenez | |
| D1,043,128 | S | 9/2024 | Jungnickel | |
| D1,045,401 | S | 10/2024 | Wainless | |
| 2001/0023516 | A1 | 9/2001 | Driesen et al. | |
| 2002/0004964 | A1 | 1/2002 | Luchino et al. | |
| 2004/0200016 | A1 | 10/2004 | Chan et al. | |
| 2006/0230563 | A1 | 10/2006 | Gavney, Jr. | |
| 2007/0163064 | A1 | 7/2007 | Wong et al. | |
| 2010/0180392 | A1 | 7/2010 | Binet et al. | |
| 2011/0047736 | A1 | 3/2011 | Jimenez et al. | |
| 2011/0296642 | A1 | 12/2011 | Driesen et al. | |
| 2014/0237744 | A1 | 8/2014 | Baertschi et al. | |
| 2015/0150366 | A1 | 6/2015 | Kim et al. | |
| 2015/0327666 | A1 * | 11/2015 | Hohlbein | A46D 1/00 300/21 |
| 2016/0353871 | A1 | 12/2016 | Xi et al. | |
| 2017/0202348 | A1 | 7/2017 | Moskovich et al. | |
| 2017/0311711 | A1 | 11/2017 | Sorrentino | |
| 2017/0354240 | A1 * | 12/2017 | Jimenez | A46B 9/04 |
| 2017/0367469 | A1 | 12/2017 | Jimenez et al. | |
| 2018/0206627 | A1 | 7/2018 | Xi et al. | |
| 2018/0242725 | A1 | 8/2018 | Hohlbein | |
| 2019/0110585 | A1 | 4/2019 | Hohlbein | |
| 2019/0125065 | A1 | 5/2019 | Altmann et al. | |
| 2021/0227963 | A1 | 7/2021 | Xie et al. | |
| 2021/0227964 | A1 | 7/2021 | Liu et al. | |
| 2021/0235855 | A1 | 8/2021 | Jimenez | |
| 2021/0368973 | A1 | 12/2021 | Sprosta et al. | |
| 2022/0142348 | A1 | 5/2022 | Xie et al. | |

FOREIGN PATENT DOCUMENTS

| | | | |
|---|---|---|---|
| BR | DI7102573-1 | | 1/2013 |
| CA | 2163314 | | 6/1996 |
| CA | 2741832 | | 5/2010 |
| CA | 3078856 | | 10/2018 |
| CN | 1214894 | | 4/1999 |
| CN | 1371645 | | 10/2002 |
| CN | 1426283 | | 6/2003 |
| CN | 1475184 | | 2/2004 |
| CN | 1493236 | | 5/2004 |
| CN | 1504139 | | 6/2004 |
| CN | 2621489 | | 6/2004 |
| CN | 2621489 | Y | 6/2004 |
| CN | 3406091 | | 11/2004 |
| CN | 1813611 | | 8/2006 |
| CN | 101011200 | | 8/2007 |
| CN | 101057728 | | 10/2007 |
| CN | 101066178 | | 11/2007 |
| CN | 300773949 | | 5/2008 |
| CN | 300786056 | | 6/2008 |
| CN | 100401940 | | 7/2008 |
| CN | 201256721 | | 6/2009 |
| CN | 201499805 | | 6/2010 |
| CN | 301372885 | | 11/2010 |
| CN | 301413563 | | 12/2010 |
| CN | 201894324 | | 7/2011 |
| CN | 102202601 | | 9/2011 |
| CN | 301736977 | | 11/2011 |
| CN | 301736982 | | 11/2011 |
| CN | 202069134 | | 12/2011 |
| CN | 301850474 | | 3/2012 |
| CN | 302037495 | | 8/2012 |
| CN | 302098067 | | 10/2012 |
| CN | 202514896 | | 11/2012 |
| CN | 302443083 | | 5/2013 |
| CN | 302500154 | | 7/2013 |
| CN | 302691167 | | 12/2013 |
| CN | 302860733 | | 7/2014 |
| CN | 105358009 | | 2/2016 |
| CN | 105517461 | | 4/2016 |
| CN | 105828746 | | 8/2016 |
| CN | 303991831 | | 1/2017 |
| CN | 106419055 | | 2/2017 |
| CN | 106998896 | | 8/2017 |
| CN | 106998897 | | 8/2017 |
| CN | 106998897 | A | 8/2017 |
| CN | 107635432 | | 1/2018 |
| CN | 108135348 | | 6/2018 |
| CN | 108135348 | A | 6/2018 |
| CN | 108495577 | | 9/2018 |
| DE | 102009024923 | | 12/2010 |
| DE | 102010014928 | | 10/2011 |
| EM | D000061387-0001 | | 12/2003 |
| EM | D000097415-0005 | | 2/2004 |
| EM | D000992961-001 | | 10/2008 |
| EM | 001165708-0002 | | 9/2009 |
| EM | D001638636-0001 | | 1/2010 |
| EM | D001224166-0001 | | 7/2010 |
| EM | D001224166-0002 | | 7/2010 |
| EM | D001235436-0001 | | 1/2011 |
| EM | D001280820-0003 | | 7/2011 |
| EM | D001224919-0001 | | 1/2013 |
| EM | 008266779-0004 | | 11/2020 |
| EM | 008266779-0005 | | 11/2020 |
| EP | 0433773 | | 6/1991 |
| EP | 0768832 | | 4/1997 |
| EP | 1339346 | | 9/2003 |
| EP | 2385772 | | 11/2011 |
| EP | 2700331 | | 2/2014 |
| EP | 2910143 | | 8/2015 |
| EP | 2929803 | | 10/2015 |
| EP | 3381319 | | 10/2018 |
| EP | 3381320 | | 10/2018 |
| EP | 3381321 | | 10/2018 |
| EP | 3381322 | | 10/2018 |
| EP | 3402364 | | 11/2018 |
| EP | 001472484-0001 | | 6/2019 |
| GB | 2371217 | | 7/2002 |

(56) References Cited

FOREIGN PATENT DOCUMENTS

| | | | |
|---|---|---|---|
| IN | 191195 | | 10/2003 |
| IN | 197633 | | 6/2004 |
| IN | 201790 | | 4/2005 |
| IN | 201791 | | 4/2005 |
| IN | 199706 | | 6/2005 |
| IN | 203425 | | 9/2005 |
| IN | 202093 | | 10/2005 |
| IN | 203943 | | 10/2005 |
| IN | 203978 | | 4/2006 |
| IN | 206601 | | 5/2007 |
| IN | 207535 | | 7/2007 |
| IN | 207536 | | 7/2007 |
| IN | 213024 | | 3/2008 |
| IN | 213025 | | 3/2008 |
| IN | 214437 | | 3/2008 |
| IN | 214438 | | 3/2008 |
| IN | 214440 | | 3/2008 |
| IN | 214441 | | 3/2008 |
| IN | 214442 | | 3/2008 |
| IN | 219038 | | 6/2008 |
| IN | 232733 | | 3/2009 |
| IN | 194520 | | 7/2009 |
| IN | 249094 | | 10/2011 |
| JP | 2000-117 | | 1/2000 |
| JP | 2000004945 | | 1/2000 |
| JP | 2000004945 | A * | 1/2000 |
| JP | 2005-103184 | | 4/2005 |
| JP | 2006-149419 | | 6/2006 |
| JP | 2008-142371 | | 6/2008 |
| JP | D1421458 | | 8/2011 |
| JP | 2013-085586 | | 5/2013 |
| JP | D1551400 | | 6/2016 |
| JP | D1530063 | | 7/2018 |
| KR | 30-0365768 | | 10/2004 |
| KR | 3003868130000 | | 7/2005 |
| KR | 3004421640000 | | 3/2007 |
| KR | 3004585160000 | | 8/2007 |
| KR | 20080095011 | | 10/2008 |
| KR | 3008205200001 | | 10/2015 |
| KR | 300826820001 | | 11/2015 |
| KR | 3008262820001 | | 11/2015 |
| KR | 300905009.0000 | | 5/2017 |
| KR | 3008205150001 | | 10/2021 |
| MX | E/2008/005529 | | 1/2008 |
| MX | E/2011/032927 | | 5/2011 |
| PA | E/2003/049205 | | 11/2003 |
| RU | 45898 | | 6/2005 |
| RU | 2267286 | | 1/2006 |
| RU | 52229 | | 3/2006 |
| RU | 83717 | | 6/2009 |
| RU | 00126666 | | 8/2021 |
| TW | 592455 | | 6/2004 |
| TW | D153413 | | 5/2013 |
| TW | D174985 | | 4/2016 |
| TW | D174986 | | 4/2016 |
| TW | D202957 | | 3/2020 |
| TW | D202958 | | 3/2020 |
| TW | D202959 | | 3/2020 |
| WO | 1995/006420 | | 3/1995 |
| WO | 2001/032053 | | 5/2001 |
| WO | 2001/082741 | | 11/2001 |
| WO | 2002/045617 | | 6/2002 |
| WO | 2004/028235 | | 4/2004 |
| WO | 2004/062573 | | 7/2004 |
| WO | 2004/080237 | | 9/2004 |
| WO | 2004/093718 | | 11/2004 |
| WO | 2004/112538 | | 12/2004 |
| WO | 2005/087046 | | 9/2005 |
| WO | 2006/062187 | | 6/2006 |
| WO | 2006/062265 | | 6/2006 |
| WO | 2006/107123 | | 10/2006 |
| WO | 2007/016802 | | 2/2007 |
| WO | 2007/043848 | | 4/2007 |
| WO | 2007/073045 | | 6/2007 |
| WO | 2007/104381 | | 9/2007 |
| WO | 2008/022480 | | 2/2008 |
| WO | 2008/060005 | | 5/2008 |
| WO | 2008/111792 | | 9/2008 |
| WO | 2008/138158 | | 11/2008 |
| WO | 2009/084637 | | 7/2009 |
| WO | 2010/069917 | | 6/2010 |
| WO | 2010/069919 | | 6/2010 |
| WO | 2010/119688 | | 10/2010 |
| WO | 2011/014000 | | 2/2011 |
| WO | 2014/098853 | | 6/2014 |
| WO | 2016/105372 | | 6/2016 |
| WO | 2017/044072 | | 3/2017 |
| WO | 2017/123146 | | 7/2017 |
| WO | 2017/182355 | | 10/2017 |
| WO | 2018/193947 | | 10/2018 |
| WO | 2020/118604 | | 6/2020 |

OTHER PUBLICATIONS

Colgate, Colgate Cushion Clean Super Dense Fluffy Thin Toothbrush Valuepack (Soft), 2ct, retrieved Jun. 15, 2022 from Amazon website, https://www.amazon.sg/Colgate-Cushion-Fluffy-Toothbrush-Valuepack/dp/B07VM7RS5S, pp. 1-4.

Colgate, Colgate CushionClean Kids Toothbrush(Random Color) 1pc, retrieved Jun. 15, 2022 from Mannings Online Store, https://www.mannings.com.hk/colgate-cushion-clean-kids-toothbrush-random-color-1pc/p/258426#, pp. 1-4.

International Search Report and Written Opinion of the International Searching Authority in International Application No. PCT/CN2018/120836, mailed Sep. 18, 2019.

premusa.com, Premier Dental "Premier Dental 2pro® Disposable Prophy Angle," http://www.premusa.com/product/hygienepreventative/2pro/, retrieved Dec. 6, 2017, pp. 1-3.

smilemakers.com, "100 Funimals™ Disposable Prophy Angles—Dental Toys from SmileMakers," https://www.smilemakers.com/funimals-disposable-prophy-angles.html?gclid=CjwKCAiApJnRBRBIEiwAPTgmxCGK37ZmCA9UT1RHZi7uOtVbBA4osLk6OSYWESGpONqourJ9cTP5xoC2c4QAvD_BwE, retrieved Dec. 6, 2017, pp. 1-2.

International Search Report and Written Opinion of the International Searching Authority in International Application No. PCT/CN2018/120838, mailed Sep. 11, 2019.

Colgate Fluffy Paw Toothbrush, retrieved ( Jul. 18, 2023) retrieved from internet, https://www.mannings.com.hk/colgate-fluffy-paw-toothbrush-1pc-random-colour/p/474676 (Year 2023).

Colgate Optic White Pro Series Charcoal Toothbrushes, posted Jan. 13, 2023 [online], [retrieved Jul. 18, 2023]. Retrieved from internet, https://www.amazon.com/dp/BBQPSB3GG (Year: 2023).

Colgate Renewal Manual Toothbrush, 2 Count [on-line]. [Publication date Sep. 21, 2, 2023] [Internet retrieval date Sep. 21, 2023], https://www.amazon.com/Colgate-Renewal-Manual-Toothbrushes-Massage/dp/B08M9T56H7/ref=asc_df_B08M9T56H7?tag=bingshoppinga-20&linkCode=df0&hvadid=79920866478923&hvnetw=0&hvqmt=e&hvbmt=be&hvdev=c&hvlocint=&hvlocphy=&hvtargid=pla-4583520396658703&psc=1 (Year:2023).

Philips Sonicare Airfloss Ultra, posted Sep. 22, 2017 [online], [retrieved Jul. 18, 2023]. Retrieved from internet, https://www.amazon.cn/dp/BOOSDFFYU0/?th=1 (Year:2017).

YNG Disp Prophy Angle Classic, posted Aug. 25, 2018 [online], [retrieved Jul. 18, 2023]. Retrieved from internet, https:/www.amazon.com/dp/B07GTD5DJL/ (Year:2018).

Colgate Gentle Kids Fluffy Paw Toothbrush, earliest accessible review Sep. 27, 2023 [online], [retrieved Oct. 21, 2024]. Retrieved from internet, https://www.lazada.sg/products/colgate-gentle-kids-fluffy-paw-toothbrush-1s-i2839019252-s19572309362.html (Year: 2023).

Colgate Kids Toothbrush, 5+ years, yellow, posting date unknown [online], [retrieved Oct. 21, 2024]. Retrieved from internet, https://makeupstore.com/product/766902/ (Year: 2024).

* cited by examiner

ORAL CARE IMPLEMENT

CROSS-REFERENCE TO RELATED APPLICATIONS

The present application is a continuation of U.S. patent application Ser. No. 16/616,187, filed Nov. 22, 2019, which is a national stage entry under 35 U.S.C. § 371 of PCT/CN2018/120838, filed Dec. 13, 2018, the entirety of which is incorporated herein by reference.

BACKGROUND

Myriad implements and devices for maintaining oral health are known. For example, toothbrushes of both the manual and powered variety, floss, dentifrices, applicators, agents, and the like are all known to provide different benefits in the oral cavity. The main components used for cleaning of the teeth are the cleaning elements of a toothbrush, which may include filament bristles as well as rubber elements known in the art as lamella. Different toothbrush users desire different mouthfeels during toothbrushing. Specifically, some people prefer a harder brush that provides the users with confidence that the cleaning elements are removing debris from the teeth. However, other people find such hard brushes to cause discomfort and prefer softer cleaning elements and a softer mouthfeel during brushing. Thus, a need exists for a tooth cleaning implement that provides the desired mouthfeel while also adequately cleaning plaque and other debris from the teeth and gums.

BRIEF SUMMARY

The present invention is directed to an oral care implement having a head with a bristle bearing surface. The oral care implement may include a central bristle tuft extending from a central portion of the bristle bearing surface, the central bristle tuft terminating in a domed distal surface. Furthermore, the oral care implement may include a plurality of perimetric bristle tufts extending from the bristle bearing surface and arranged to circumferentially surround the central bristle tuft. Each of the perimetric bristle tufts may have an inclined distal surface that slopes downward towards the central bristle tuft. The bristle bearing surface of the head may have a total surface area (TSA), and the toothbrush may include a tooth cleaning element field having X number of tooth cleaning elements that collectively occupy a total cleaning element area (TCEA) such that $$\frac{1}{X} \times \frac{TCEA}{TSA} = Z$$

and Z is in a range of 0.04 to 0.065.

In one aspect, the invention may be an oral care implement comprising: a head extending along a longitudinal axis and having a bristle bearing surface, a rear surface opposite the bristle bearing surface, and a side surface extending between the bristle bearing surface and the rear surface; a central bristle tuft extending from a central portion of the bristle bearing surface, the central bristle tuft terminating in a domed distal surface; and a plurality of perimetric bristle tufts arranged to circumferentially surround the central bristle tuft, each of the plurality of perimetric bristle tufts comprising an inclined distal surface that slopes downward toward the central bristle tuft.

In another aspect, the invention may be an oral care implement comprising: a head extending along a longitudinal axis and having a front surface, a rear surface opposite the front surface, and a side surface extending between the front surface and the rear surface, the front surface having a total surface area (TSA); a tooth cleaning element field extending from the front surface, the tooth cleaning element field consisting of X number of tooth cleaning elements, the X number of tooth cleaning elements collectively occupying a total cleaning element area (TCEA); wherein $$\frac{1}{X} \times \frac{TCEA}{TSA} = Z;$$

and Z being in a range of 0.04 to 0.065.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
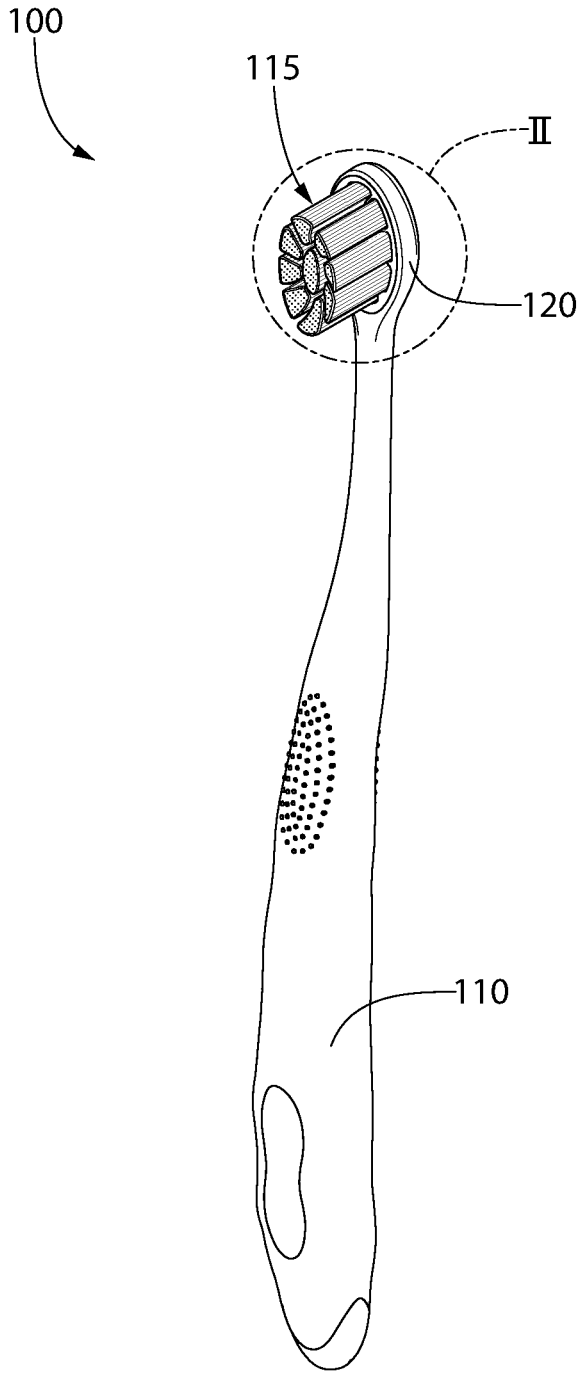
FIG. 1 is a front perspective view of an oral care implement in accordance with an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as “lower,” “upper,” “horizontal,” “vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Referring first to FIG. 1, an oral care implement 100 will be described in accordance with an embodiment of the present invention. The oral care implement 100 generally comprises a handle 110 and a head 120. The handle 110 and the head 120 may be formed as an integral, monolithic structure during an injection molding process. Thus, in some embodiments the handle 110 and the head 120 may be formed from a rigid plastic material, such as those mentioned below. Of course, the invention is not to be limited by this structure in all embodiments and in alternative embodiments the head 120 may be detachable from the handle 110 so that the head 120 is a refill head as that term is commonly known in the art. In such embodiments it may be possible to replace the head 120 with a new head while maintaining the same handle 110. The general shape of the handle 110 and the head 120 is not to be limited to that which is depicted in the drawings in all embodiments, with the drawings merely depicting one exemplary and non-limiting embodiment.

The handle 110 is an elongated structure that provides the mechanism by which the user can hold and manipulate the oral care implement 100 during use. In the exemplified embodiment, the handle 110 is generically depicted having various contours for user comfort. Of course, the invention is not to be so limited in all embodiments and in certain other embodiments the handle 110 can take on a wide variety of shapes, contours and configurations, none of which are limiting of the present invention unless so specified in the claims. In the exemplified embodiment, the handle 110 and the head 120 are formed of a rigid plastic material, such as, for example without limitation, polymers and copolymers of ethylene, propylene, butadiene, vinyl compounds, and polyesters such as polyethylene terephthalate. Of course, the handle 110 may include a resilient material, such as a thermoplastic elastomer, as a grip cover that is molded over portions of or the entirety of the handle 110 to enhance the gripability of the handle 110 during use. For example, portions of the handle 110 that are typically gripped by a user's palm during use may be overmolded with a thermoplastic elastomer or other resilient material to further increase comfort to a user. Moreover, the head 120 could also include a resilient material such as a thermoplastic elastomer on its rear surface to provide a tongue or cheek cleaning function.

The oral care implement 100 further comprises a plurality of cleaning elements 115 coupled to and extending from the head 120. The plurality of cleaning elements 115 could be coupled to the head using any technique now known or later discovered, including staples, anchor-free tufting (AFT), in-mold tufting (IMT), Pressure-Temperature-Time (PTt) anchorless tufting technology, or the like. In staple technology, the bristle tufts are folded into a U shape and then a staple is used to secure the bristle tufts within a tuft hole. In AFT, the bristle tufts are inserted through holes in a head plate and the ends of the tufts that extend from the back of the head plate are melted together to form a layer of bristle material that lies adjacent to the rear surface of the head plate. This prevents the bristle tufts from being pulled back through the tuft holes. The head plate is then secured to the head using ultrasonic welding, adhesives, or the like. In PTt, the bristle filaments are arranged in tufts and then individual tufts are melted together to form tufts having a mushroom shaped end. The tufts with the mushroom shaped ends are then inserted in pre-cored holes of a toothbrush head. Then, pressure and heat is applied to the toothbrush head, which causes the surface of the toothbrush head to reshape itself to enclose the mushroom-shaped ends of the tufts, holding them firmly. The invention is not intended to be particularly limited by the manner in which the cleaning elements 115 are coupled to the head 120. However, the cleaning elements 115 should be coupled to the head 120 in such a manner so that they extend from the head 120 so that they can be used to clean a user's teeth, gums, and other oral surfaces. The cleaning elements 115 could extend perpendicularly from the head 120 or at an angle relative to the head 120, or combinations thereof, as may be desired.

Figure 2:
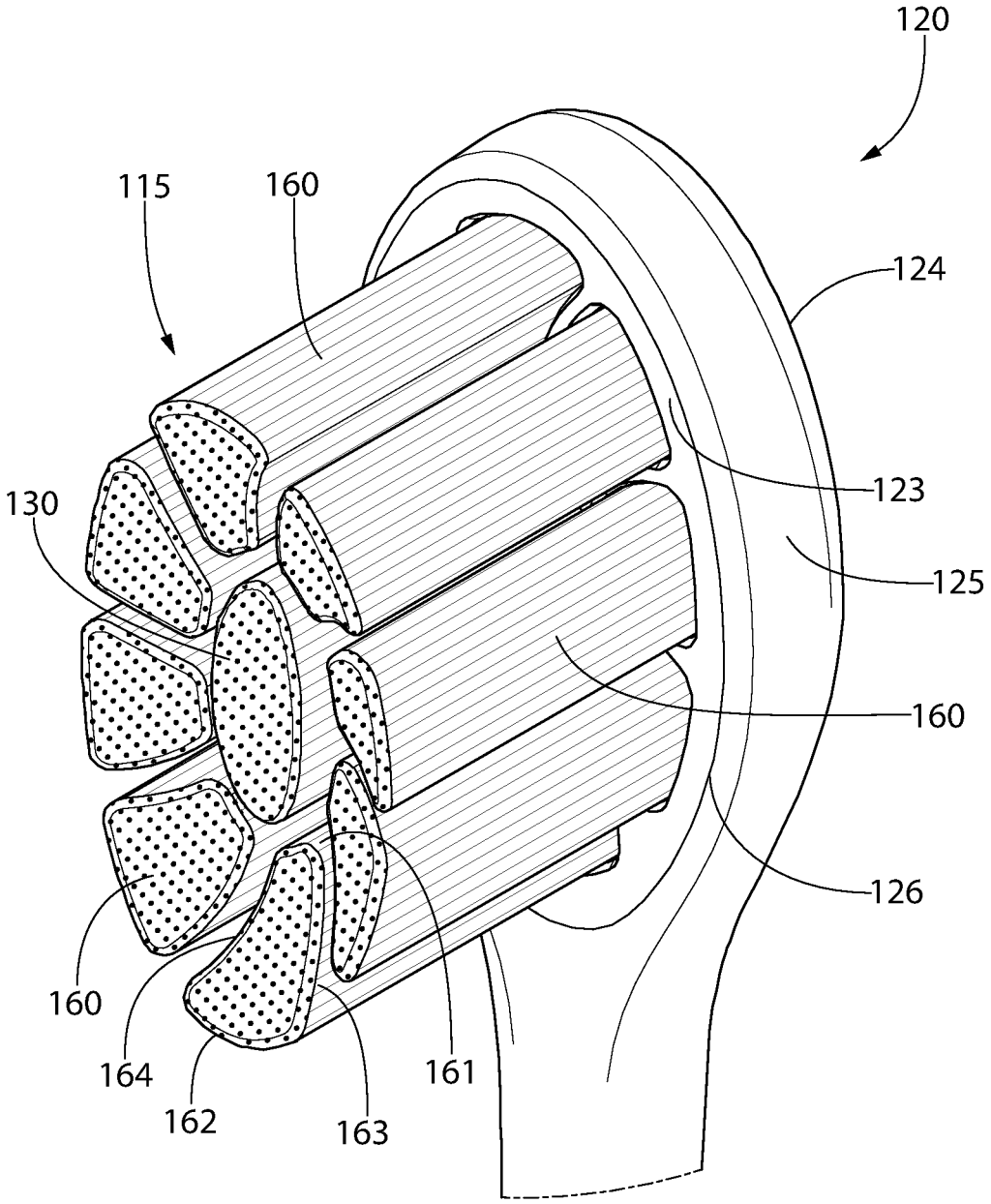
FIG. 2 is a close-up view a head of the oral care implement of FIG. 1 depicted as area II of FIG. 1.
Figure 3:
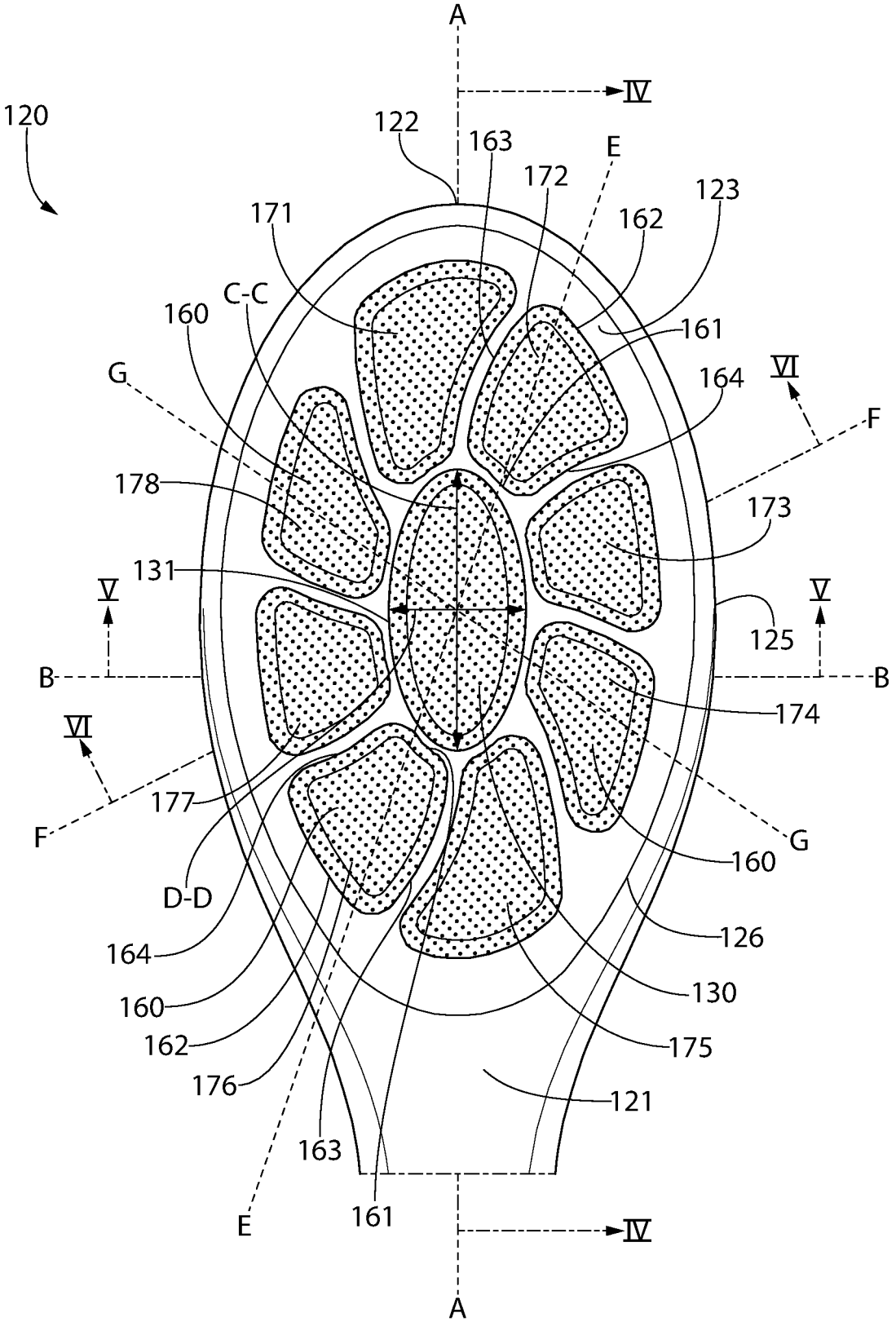
FIG. 3 is a front view of the head of FIG. 2.

Referring to FIGS. 2 and 3, the head 120 and the cleaning elements 115 will be described in greater detail. The head 120 extends from a proximal end 121 to a distal end 122 and comprises a longitudinal axis A-A that extends between the proximal and distal ends 121, 122. The head 120 also comprises a transverse axis B-B that is perpendicular to the longitudinal axis A-A and equidistant to the proximal and distal ends 121, 122 of the head 120. The head 120 further comprises a front surface 123, a rear surface 124 opposite the front surface 123, and a lateral surface 125 that extends between the front and rear surfaces 123, 124. The transverse axis B-B of the head 120 is oriented so as to intersect the lateral surface 125 of the head 120 twice while being perpendicular to the longitudinal axis A-A. The front surface 123 of the head 120 is the surface from which the cleaning elements 115 extend. Thus, the front surface 123 of the head 120 may be referred to herein as a bristle bearing surface. When AFT is used, the head plate may be deemed to form a part of the head such that the front surface of the head plate forms at least a part of the front surface of the head.

The cleaning elements 115 generally comprise a central bristle tuft 130 and a plurality of perimetric bristle tufts 160 that are arranged to circumferentially surround the central bristle tuft 130. Not all of the perimetric bristle tufts 160 are labeled in the drawings in order to avoid clutter, but it should be readily understood and appreciated which of the cleaning elements 115 are the perimetric bristle tufts 160. The perimetric bristle tufts 160 are not all identical to one another, but rather some of the perimetric bristle tufts 160 have different transverse cross-sectional areas and different shapes when viewed from a top plan view than others. This will be discussed in greater detail below. Generally, the perimetric bristle tufts 160 are configured in pairs such that the perimetric bristle tufts 160 of each pair have the same shape, but a different shape than the perimetric bristle tufts 160 of each other pair.

The central bristle tuft 130 is coupled to the head 120 within a tuft hole and located within a central portion of the front surface 123 of the head 120. In the exemplified embodiment, the central bristle tuft 130 is located at an intersection of the longitudinal axis A-A of the head 120 and the transverse axis B-B of the head 120. Each of the perimetric bristle tufts 160 is coupled to the head 120 within a separate tuft hole located along a perimeter portion of the front surface 123 of the head 120 that surrounds the central portion of the front surface 123 of the head 120. In the exemplified embodiment, the longitudinal axis A-A intersects two of the perimetric bristle tufts 160 and the central bristle tuft 130. Specifically, in the exemplified embodiment the longitudinal axis A-A divides the central bristle tuft 130 into two equal halves having the same cross-sectional area, but divides the two perimetric bristle tufts 160 that it intersects into two portions having different cross-sectional areas. Thus, the perimetric bristle tufts 160 that are intersected by the longitudinal axis A-A are not symmetric about the longitudinal axis A-A whereas the central bristle tuft 130 is symmetric about the longitudinal axis A-A.

In the exemplified embodiment, the central bristle tuft 130 comprises a plurality of filament bristles. In fact, in the exemplified embodiment the central bristle tuft 130 consists of a plurality of filament bristles. Similarly, in the exemplified embodiment each of the perimetric bristle tufts 160 comprises or consists of a plurality of filament bristles. Such filament bristles may include combinations of end-rounded bristles, tapered bristles, spiral bristles, bi-core bristles, core-sheath bristles, or any other type of bristle now known or later discovered. The filament bristles may be formed from nylon or other well-accepted materials commonly used for forming toothbrush bristles. For example, the filament bristles may be made from animal hair or other natural materials, nylon-polyester blends, or other plastic materials. The filament bristles may also have any desired thickness/diameter or different filament bristles may have different thicknesses/diameters, ranging from 4 mils to 9 mils, and more specifically 5 mils to 7 mils. It may also be possible for some of the cleaning elements 115 to be formed from a resilient material, such as rubber, thermoplastic elastomer, or the like. However, in some preferred embodiments the cleaning elements 115 do not include any such resilient or rubber elements, but rather all of the cleaning elements 15 are bristle tufts comprising (or consisting of) filament bristles.

In some embodiments, the central bristle tuft 130 is formed by a plurality of first bristles having a first root dimeter and each of the plurality of perimetric bristle tufts 160 is formed by a plurality of second bristles having a second root diameter. The root diameter of the first and second bristles is the diameter of the bristle near its end that is located within the tuft hole in the head 120. Typically, the root diameter of the first and second bristles is the maximum diameter of those bristles, particularly where the first and second bristles are tapered bristles. In the exemplified embodiment, the first root diameter of the first bristles of the central bristle tuft 130 is less than the second root diameter of the second bristles of the perimetric bristle tufts 160. Thus, the perimetric bristle tufts 160 are made of up bristles having a larger diameter than that of the bristles that form the central bristle tuft 130. For example, in some embodiments the bristles of the perimetric bristle tufts 160 may be 6 mil and the bristles of the central bristle tufts 130 may be 5 mil. In other embodiments, all of the bristles of central bristle tufts 130 and of the perimetric bristle tufts 160 may be 5 mil or all of the bristles of central bristle tufts 130 and of the perimetric bristle tufts 160 may be 6 mil, with each bristle being the same thickness or diameter.

Furthermore, in some preferred embodiments each of the first bristles and each of the second bristles may be tapered bristles, although this is not required in all embodiments as noted above. Moreover, in some embodiments the first bristles of the central bristle tuft 130 may be tapered while the second bristles of the perimetric bristle tufts 160 may be end-rounded. In other embodiments, the first bristles of the central bristle tuft 130 may be end-rounded while the second bristles of the perimetric bristle tufts 160 may be tapered. In still other embodiments, all of the bristles may be non-tapered and have the same thickness (e.g., 5 mil or 6 mil). In other embodiments, the bristles of the perimetric bristle tufts 160 may be 6 mil and tapered whereas the bristles of the central bristle tuft 130 may be 5 mil and non-tapered.

In the exemplified embodiment, the central bristle tuft 130 has an elliptical transverse cross-sectional profile (or top plan view) having a major axis C-C and a minor axis D-D. The central bristle tuft 130 has a larger dimension or length measured along the major axis C-C than along the minor axis D-D. Furthermore, in the exemplified embodiment the major axis C-C extends along the longitudinal axis A-A of the head 120. Thus, if the central bristle tuft 130 is said to have a length measured along the major axis C-C and a width measured along the minor axis D-D, the length is greater than the width. The central bristle tuft 130 has an outer surface 131, as seen in the top plan view. Each of the perimetric bristle tufts 160 is positioned closely adjacent to the outer surface 131 of the central bristle tuft 130, but with a slight space or gap being present between the perimetric bristle tufts 160 and the central bristle tuft 130.

Each of the perimetric bristle tufts 160 is immediately adjacent to the central bristle tuft 130 and immediately adjacent to an outer perimeter 126 of the front surface 123 of the head 120. In the exemplified embodiment, the outer perimeter 126 of the front surface 123 of the head 120 is delineated with an oval-shaped line. Of course, the outer perimeter 126 of the front surface 123 of the head 120 may be delineated with boundaries having other shapes in other embodiments. Either way, the perimetric bristle tufts 160 extend between the outer perimeter 126 of the front surface 123 of the head 120 and the central bristle tuft 130 with no other bristles or cleaning elements being located between: (1) the perimetric bristle tufts 160 and the central bristle tuft 130; and (2) the perimetric bristle tufts 160 and the outer perimeter 126 of the front surface 123 of the head 120. Thus, the term "immediately adjacent" means that there are no intervening bristle tufts or other cleaning elements located between the two elements that are noted as being immediately adjacent. Because the perimetric bristle tufts 160 are immediately adjacent to the central bristle tuft 130, there are no cleaning elements located between the perimetric bristle tufts 160 and the central bristle tuft 130. Similarly, because the perimetric bristle tufts 160 are immediately adjacent to the outer perimeter 126 of the front surface 123 of the head 120, there are no cleaning elements located between the perimetric bristle tufts 160 and the outer perimeter 126 of the front surface 123 of the head 120. In some embodiments, the cleaning elements 115 consist only of the central bristle tuft 130 and the perimetric bristle tufts 160 with no other cleaning elements being included as a part of the oral care implement 100.

The perimetric bristle tufts 160 are not elliptical in shape but have more of a wedge-like shape. Thus, as best seen in the top plan view of FIG. 3, the perimetric bristle tufts 160 have an inner sidewall 161 that is adjacent to and faces the central bristle tuft 130 and an outer sidewall 162 that is adjacent to and faces the outer perimeter 126 of the front surface 123 of the head 120. The inner sidewalls 161 are either planar or concave and the outer sidewalls 162 are either planar or convex.

Each of the perimetric bristle tufts 160 also comprises a first-side sidewall 163 and a second-side sidewall 164 opposite the first-side sidewall 163. The first-side and second-side sidewalls 163, 164 extend between the inner and outer sidewalls 161, 162. The inner and outer sidewalls 161, 162 and the first-side and second-side sidewalls 163, 164 collectively form the outer boundary of the perimetric bristle tufts 160. In the exemplified embodiment, each of the first-side sidewalls 163 is convex and each of the second-side sidewalls 164 is concave. Furthermore, the outer sidewalls 162 are generally longer than the inner sidewalls 161, which gives the perimetric bristle tufts 160 their general wedge shape. The various sidewalls are only marked with a reference numeral with regard to a couple of the perimetric bristle tufts 160, it being understood that the above description is applicable to each of the perimetric bristle tufts 160.

As seen in FIG. 3, the perimetric bristle tufts 160 are positioned in a circumferentially side-by-side spaced apart arrangement so that for each of the plurality of perimetric bristle tufts 160, the convex first-side sidewall 163 opposes the concave second-side sidewall 164 of an adjacent one of the perimetric bristle tufts 160. Thus, the convex first-side sidewall 163 of one of the perimetric bristle tufts 160 is adjacent to and faces the concave second-side sidewall 164 of another one of the perimetric bristle tufts 160. This provides for a nesting-like appearance of the adjacently positioned perimetric bristle tufts 160. Furthermore, due to this concave-convex shape of the sidewalls, the gap or space between adjacent ones of the perimetric bristle tufts 160 is curved or arcuate.

Still referring to FIGS. 2 and 3, in the exemplified embodiment there are eight of the perimetric bristle tufts 160 on the head 120. However, this is not required in all embodiments and there could be less than eight or more than eight of the perimetric bristle tufts 160 in other embodiments. In some embodiments, however, there may be no more than ten of the perimetric bristle tufts 160.

In the exemplified embodiment, the plurality of perimetric bristle tufts 160 comprises a first perimetric bristle tuft 171, a second perimetric bristle tuft 172, a third perimetric bristle tuft 173, a fourth perimetric bristle tuft 174, a fifth perimetric bristle tuft 175, a sixth perimetric bristle tuft 176, a seventh perimetric bristle tuft 177, and an eighth perimetric bristle tuft 178. The first perimetric bristle tuft 171 has a first transverse cross-sectional profile, the second perimetric bristle tuft 172 has a second transverse cross-sectional profile, the third perimetric bristle tuft 173 has a third transverse cross-sectional profile, the fourth perimetric bristle tuft 174 has a fourth transverse cross-sectional profile, the fifth perimetric bristle tuft 175 has the first transverse cross-sectional profile, the sixth perimetric bristle tuft 176 has the second transverse cross-sectional profile, the seventh perimetric bristle tuft 177 has the third transverse cross-sectional profile, and the eighth perimetric bristle tuft 178 has the fourth transverse cross-sectional profile. Thus, the first and fifth perimetric bristle tufts 171, 175 have the same transverse cross-sectional profile, the second and sixth perimetric bristle tufts 172, 176 have the same transverse cross-sectional profile, the third and seventh perimetric bristle tufts 173, 177 have the same transverse cross-sectional profile, and the fourth and eighth perimetric bristle tufts 174, 178 have the same transverse cross-sectional profile. The first, second, third, and fourth transverse cross-sectional profiles are different from one another in the exemplified embodiment. As used herein, a transverse cross-sectional profile may also be a top plan view profile or shape as these may be the same.

In the exemplified embodiment, the plurality of perimetric bristle tufts 160 are circumferentially arranged around the central bristle tuft 130 in a clockwise order, starting with the perimetric bristle tuft that is intersected by the longitudinal axis A-A and located adjacent the distal end 122 of the head 120, of: the first perimetric bristle tuft 171, the second perimetric bristle tuft 172, the third perimetric bristle tuft 173, the fourth perimetric bristle tuft 174, the fifth perimetric bristle tuft 175, the sixth perimetric bristle tuft 176, the seventh perimetric bristle tuft 177, and the eight perimetric bristle tuft 178. The second, third, and fourth perimetric bristle tufts 172, 173, 174 are located on an opposite side of the longitudinal axis A-A relative to the sixth, seventh, and eighth perimetric bristle tufts 176, 177, 178.

In the exemplified embodiment and as noted above, the first and fifth perimetric bristle tufts 171, 175 are intersected by the longitudinal axis A-A. However, the longitudinal axis A-A does not intersect the inner sidewalls 161 of the first and fifth perimetric bristle tufts 171, 175. In fact, the inner sidewall 161 of the first perimetric bristle tuft 171 is located on a first side of the longitudinal axis A-A and the inner sidewall 161 of the fifth perimetric bristle tuft 175 is located on a second side of the longitudinal axis A-A. Stated another way, the first sidewall 161 of the first perimetric bristle tuft 171 is located on the same side of the longitudinal axis A-A as the sixth, seventh, and eighth perimetric bristle tufts 176, 177, 178 whereas the first sidewall 161 of the fifth perimetric bristle tuft 175 is located on the same side of the longitudinal axis A-A as the second, third, and fourth perimetric bristle tufts 172, 173, 174. Portions of both of the first and fifth perimetric bristle tufts 171, 175 are located on both sides of the longitudinal axis A-A.

A first axis E-E oblique to the longitudinal axis A-A intersects the second and sixth perimetric bristle tufts 172, 176, which have a first shape, a second axis F-F oblique to the longitudinal axis A-A intersects the third and seventh perimetric bristle tufts 173, 177, which have a second shape, and a third axis G-G oblique to the longitudinal axis A-A intersects the fourth and eighth perimetric bristle tufts 174, 177, which have a third shape. The first, second, and third shapes are different from one another. The longitudinal axis A-A intersects the first and fifth perimetric bristle tufts 171, 175, which have a fourth shape that is different from each of the first, second, and third shapes. The perimetric bristle tufts 160 are arranged in a repeating sequence such as: first shape, second shape, third shape, fourth shape, first shape, second shape, third shape, fourth shape, with each of the first, second, third, and fourth shapes being different from one another. In some embodiments, the number of different shapes for the perimetric bristle tufts 160 is equal to the number of the perimetric bristle tufts 160 divided by two and thus the sequence of shapes repeats twice, although it could repeat more than twice in other embodiments.

The cleaning elements 115 collectively form a tooth cleaning element field of the oral care implement. In the exemplified embodiment, the tooth cleaning element field consists of the central bristle tuft 130 and the plurality of perimetric bristle tufts 160. However, in other embodiments it may be possible to include other cleaning elements within the tooth cleaning element field.

The various perimetric bristle tufts 160 are arranged so that there is no plane that is perpendicular to the front and rear surfaces 123, 124 of the head 120 that can pass through the gap between adjacent ones of the perimetric bristle tufts 160 on a first side of the longitudinal axis A-A and a gap between adjacent ones of the perimetric bristle tufts 160 on a second side of the longitudinal axis A-A without intersecting at least one of the perimetric bristle tufts 160. For example, a plane exists that is perpendicular to the front and rear surfaces 123, 124 of the head 120 that passes through the gap between the seventh and eighth perimetric bristle tufts 177, 178 without intersecting the seventh and eighth perimetric bristle tufts 177, 178. However, this plane does not also pass through the gap between the third and fourth perimetric bristle tufts 173, 174 (or any others of the perimetric bristle tufts 173, 174) without intersecting the third and fourth perimetric bristle tufts 173, 174. Rather, this plane would in fact intersect the fourth perimetric bristle tuft 174 and would not pass through the gap between the third and fourth perimetric bristle tufts 173, 174. This is true for any plane passing through the gap between any two adjacent ones of the perimetric bristle tufts 160. Stated another way, any plane that is perpendicular to the front and rear surfaces 123, 124 of the head 120 that passes through the gap between adjacent ones of the perimetric bristle tufts 160 (without intersecting those adjacent ones of the perimetric bristle tufts 160) on one side of the longitudinal axis A-A would intersect one of the perimetric bristle tufts 160 on the other side of the longitudinal axis A-A.

The gap between any two adjacent ones of the perimetric bristle tufts 160 is arcuate shaped. Thus, due to the curvature of the sidewalls of the perimetric bristle tufts 160, for some of the adjacent perimetric bristle tufts 160 a plane does not exist that can pass through the gap without intersecting those adjacent perimetric bristle tufts 160. For example, there is no plane perpendicular to the front and rear surfaces 123, 124 of the head 120 that passes through the gap between the first and second perimetric bristle tufts 171, 172 without intersecting any part of the first and second perimetric bristle tufts 171, 172. The same is true of at least the fifth and sixth perimetric bristle tufts 175, 176.

The front surface 123 of the head 120 comprises a total surface area (which may be referred to herein by the acronym TSA), which is the surface area of the portion of the front surface 123 of the head 120 bounded by the outer perimeter 126 of the front surface 123 of the head 120. The total surface area TSA may be in a range of 200-220 $mm^2$, although surface areas above and below this range are certainly possible in other embodiments. In the exemplified embodiment, the central bristle tuft 130 has a transverse cross-sectional area that occupies between 5% and 15% of the total surface area of the front surface 123 of the head 120, more specifically between 8% and 12% of the total surface area of the front surface 123 of the head 120. Moreover, in the exemplified embodiment each of the plurality of perimetric bristle tufts 160 occupies less than 9% of the total surface area of the front surface 123 of the head 120. In some embodiments, no individual one of the central bristle tuft 130 and the plurality of perimetric bristle tufts 160 occupies more than 9% of the total surface area of the first surface 123 of the head 120. In some embodiments, the central bristle tuft 130 and the plurality of perimetric bristle tufts 130 collectively occupy at least 50% of the total surface area of the front surface 123 of the head 120.

As noted above, the front surface 123 of the head 120 has a total surface area TSA. Furthermore, the cleaning elements 115 (also referred to herein as tooth cleaning elements) collectively occupy a total cleaning element area (TCEA), which is a portion of the total surface area TSA of the front surface 123 of the head 120 that is occupied by the cleaning elements 115. In some embodiments the total cleaning element area TCEA may be in a range of 105-120 $mm^2$, although TCEA outside of the noted range is possible in other embodiments. In some embodiments, $$\frac{TCEA}{TSA}$$

may be in a range or 0.4 to 0.6, or more specifically 0.45 to 0.55, and still more specifically 0.5-0.55. Thus, the cleaning elements 115 may collectively occupy approximately 40%-60%, more specifically 45% to 55%, and still more specifically 50% to 55% of the total surface area TSA of the front surface 123 of the head 120.

There may be any desired number of cleaning elements 115 on the head 120. Thus, it may be recited that there are X number of tooth cleaning elements 115 on the head 120, with each of the tooth cleaning elements 115 being a distinct bristle tuft. Thus, in the exemplified embodiment there are nine tooth cleaning elements (i.e., X=9), but there could be more than nine or less than nine tooth cleaning elements in other embodiments. In some embodiments there may be between five and fifteen tooth cleaning elements, and thus X may be in a range of 5 to 15, or more specifically 5 to 10. In the exemplified embodiment, each of the tooth cleaning elements may occupy less than 9% of the total surface area of the front surface 123 of the head 120 as noted above. In some embodiments, each of the tooth cleaning elements 115 may occupy between 5% and 25% of the total surface area of the front surface 123 of the head 120. More specifically, in some embodiments each of the perimetric bristle tufts 160 may occupy between 5% and 8% of the total surface area TSA of the front surface 123 of the head 120 and the central bristle tuft 130 may occupy between 8% and 12% of the total surface area TSA of the front surface 123 of the head 120.

Moreover, in the exemplified embodiment each of the perimetric bristle tufts 160 may occupy between 8% and 13% of the tooth cleaning element area TCEA whereas the central bristle tuft 130 may occupy between 15% and 21% of the tooth cleaning element area TCEA. In some embodiments, the perimetric bristle tufts 160 may each occupy between 9% and 13% of the TCEA while the central bristle tuft 130 occupies between 14% and 17% of the TCEA. In another embodiment, each of the perimetric bristle tufts 160 may occupy between 8% and 12% of the TCEA while the central bristle tuft 130 occupies between 20% and 22% of the TCEA. Thus, the central bristle tuft 130 may have a transverse cross-sectional area that is greater than the transverse cross-sectional area of each of the perimetric bristle tufts 160. Stated another way, the central bristle tuft 130 occupies a greater surface area of the front surface 123 of the head 120 than each of the perimetric bristle tufts 160 individually. In some embodiments, the central bristle tuft 130 may occupy a greater surface area of the front surface 123 of the head 120 than two of the perimetric bristle tufts 160 collectively.

In some embodiments, $$\frac{1}{X} \times \frac{TCEA}{TSA} = Z,$$

such that Z is in a range of 0.04 to 0.065, or more specifically 0.05 to 0.062. Specifically, in the exemplified embodiment X is nine because there are nine bristle tufts (one central bristle tuft 130 and eight perimetric bristle tufts 160). Furthermore, TCEA/TSA equals somewhere in a range of 0.5 and 0.55. Thus, (1/9)*0.5=0.056 and (1/9)*0.55=0.061, both falling with the range of 0.05 to 0.062. Modifications to X, TCEA, and/or TSA may be made in some embodiments while Z remains within the range provided in this disclosure.

In the exemplified embodiment, the first and fifth perimetric bristle tufts 171, 175 have the same transverse cross-sectional area, the second and sixth perimetric bristle tufts 172, 176 have the same transverse cross-sectional area, the third and seventh perimetric bristle tufts 173, 177 have the same transverse cross-sectional area, and the fourth and eighth perimetric bristle tufts 174, 178 have the same transverse cross-sectional area. Furthermore, in the exemplified embodiment the first, second, third, and fourth perimetric bristle tufts 171-174 all have a different transverse cross-sectional area from one another and the fifth, sixth, seventh, and eighth perimetric bristle tufts 175, 178 all have a different transverse cross-sectional area from one another. In some embodiments, the first and fifth perimetric bristle tufts 171, 175 have the largest transverse cross-sectional area of the perimetric bristle tufts 160, the second and sixth perimetric bristle tufts 172, 176 have the second largest transverse cross-sectional area of the perimetric bristle tufts 160, the fourth and eighth perimetric bristle tufts 174, 178 have the third largest transverse cross-sectional area of the perimetric bristle tufts 160, and the third and seventh perimetric bristle tufts 173, 177 have the smallest transverse cross-sectional area of the perimetric bristle tufts 160. However, modifications to this may be possible in some alternative embodiments. As noted above, the central bristle tuft 130 may have a larger transverse cross-sectional area than each of the perimetric bristle tufts 160 taken individually.

Figure 4:
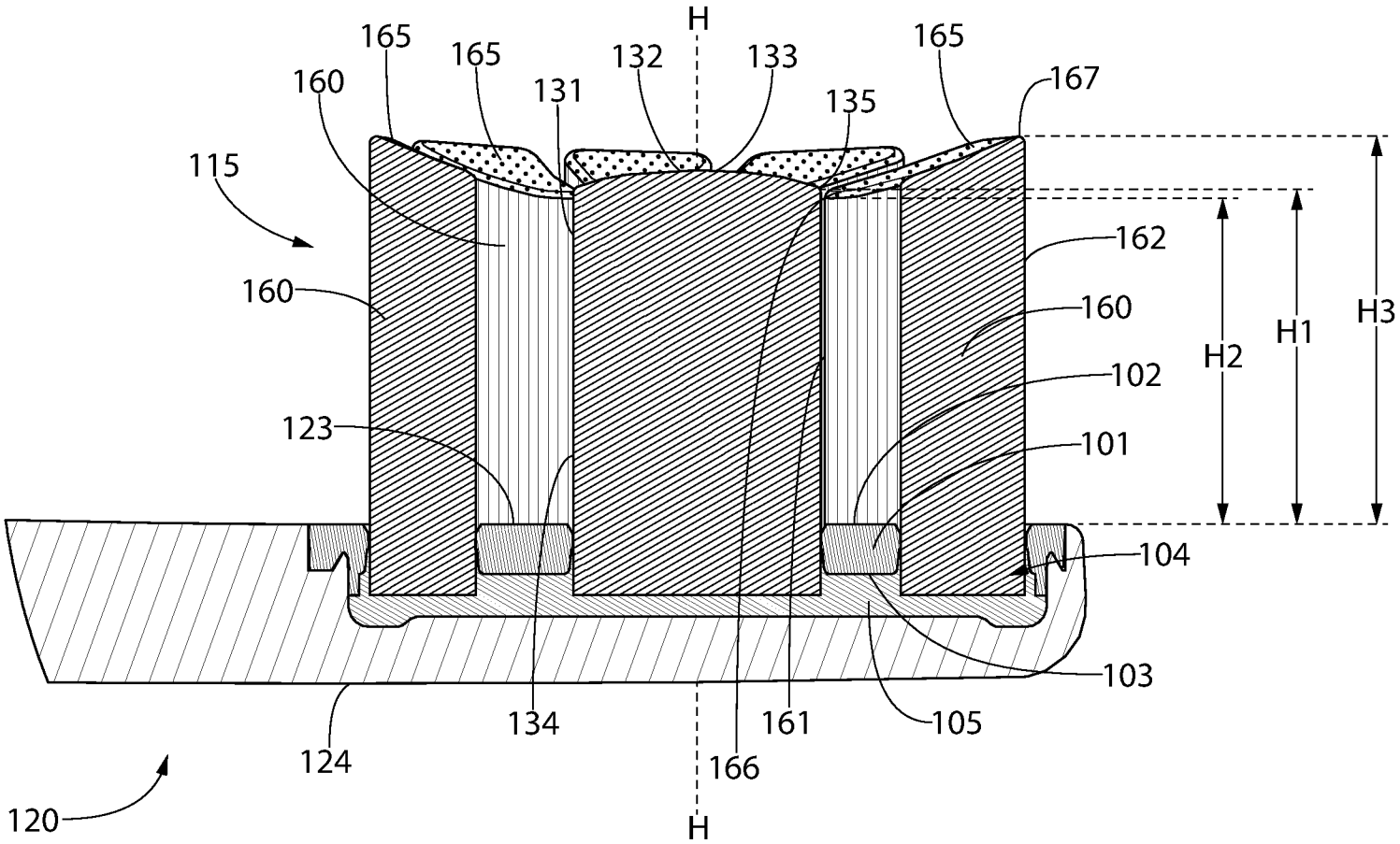
FIG. 4 is a cross-sectional view taken along line IV-IV of FIG. 3.
Figure 5:
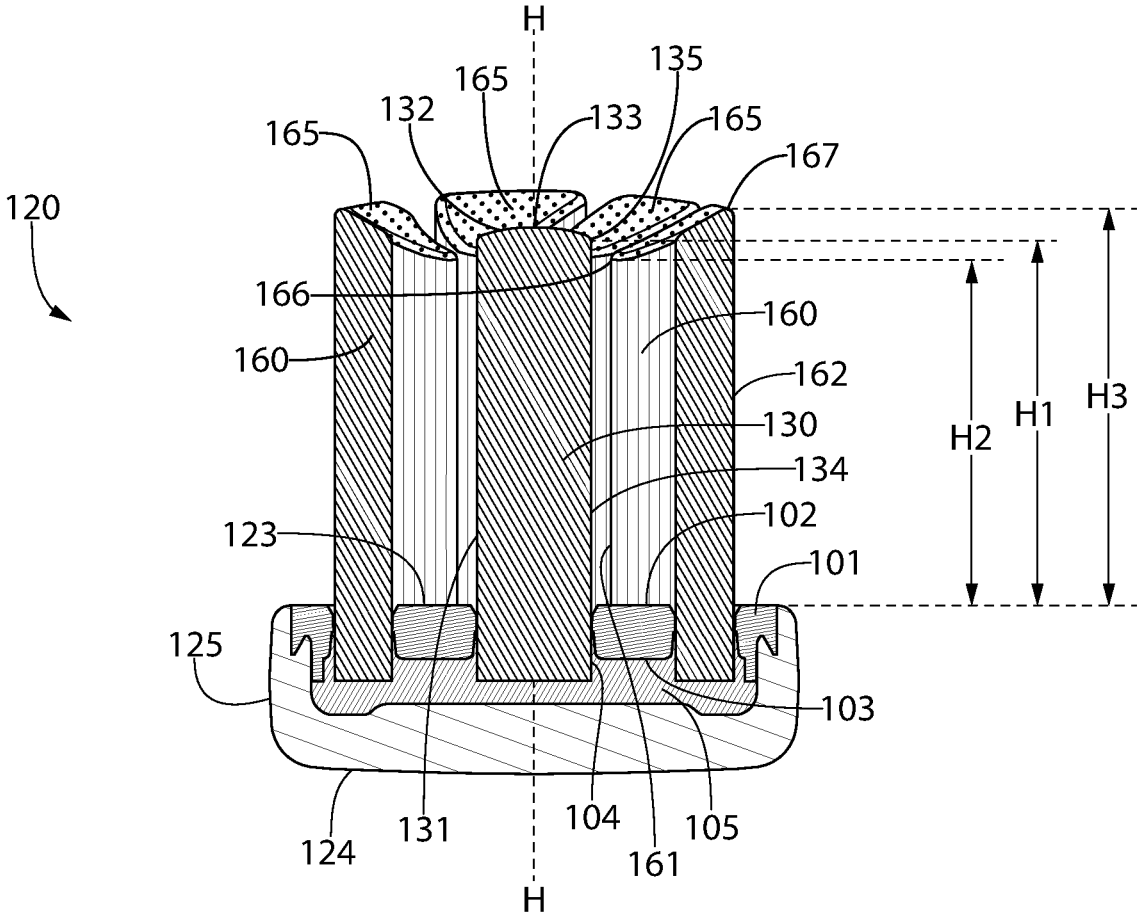
FIG. 5 is a cross-sectional view taken along line V-V of FIG. 3.
Figure 6:
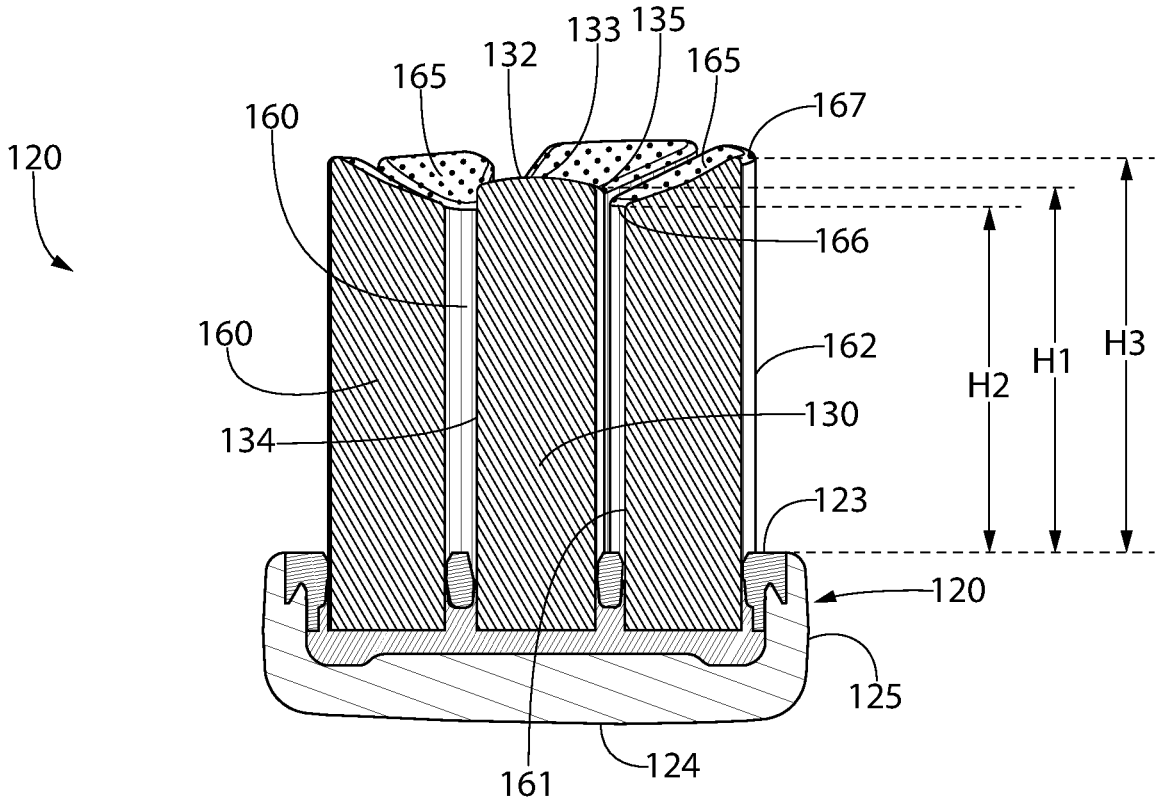
FIG. 6 is a cross-sectional view taken along line VI-VI of FIG. 3.

Referring now to FIGS. 4-6 concurrently, various cross-sectional views taken through the head 120 of the oral care implement 100 are provided and will be described. In this embodiment, the cleaning elements 115 are coupled to the head 120 using an AFT technique. Specifically, in this embodiment there is provided a head plate 101 having a front surface 102, a rear surface 103, and a plurality of holes 104 extending therethrough. The cleaning elements 115 are assembled into bristle tufts 130, 160 and inserted into the holes 104 in the head plate 101 so that a first portion of the bristle tufts 130, 160 protrudes from the front surface 102 of the head plate 101 and a second portion of the bristle tufts 130, 160 protrudes from the rear surface 103 of the head plate 101. The second portions of the bristle tufts 130, 160 are melted with heat and then allowed to cool, which forms a melt matte 105 that is positioned against the rear surface 103 of the head plate 101. The first portions of the bristle tufts 130, 160 extend from the front surface 102 of the head plate 101 and are used for cleaning of the user's oral cavity surfaces. The melt matte 105 prevents the bristle tufts 130, 160 from being pulled through the front of the head plate 101. The head plate 101 is coupled to the head using welding (possibly ultrasonic welding), adhesives, mechanical interaction, or the like. Of course, any of the other techniques, some of which have been described or mentioned herein, can be used for coupling the cleaning elements 115 to the head 120.

The central bristle tuft 130 extends from the central portion of the front surface 123 of the head 120 and terminates in a domed distal surface 132. As seen in FIG. 4, the domed distal surface 132 is convex in longitudinal side profile. As seen in FIG. 5, the domed distal surface 132 is also convex in transverse side profile. Thus, the domed distal surface 132 of the central bristle tuft 130 is fully dome shaped in the exemplified embodiment. Furthermore, in the exemplified embodiment the domed distal surface 132 of the central bristle tuft 130 is an uninterrupted surface that is free of a central opening. Thus, the domed distal surface 132 is a continuous surface that has no breaks, holes, openings, or the like therein (other than the normal and natural spacing that might exist between individual bristle filaments in a bristle tuft).

The central bristle tuft 130 extends along a central tuft axis H-H from a bottom end of the central bristle tuft 130 to the domed distal surface 132. The domed distal surface 132 of the central bristle tuft 130 has an apex 133 located along the central tuft axis H-H. Thus, the highest part of the domed distal surface 132, which is formed by or at the apex 133, is aligned with the central tuft axis H-H. The central bristle tuft 130 has a sidewall 134 that circumscribes the central tuft axis H-H. The sidewall 134 of the central bristle tuft 130 forms the outer surface 131 of the central bristle tuft 130. In the exemplified embodiment, the sidewall 134 of the central bristle tuft 130 is oriented substantially perpendicular to the front surface 123 of the head 120.

The sidewall 134 of the central bristle tuft 130 intersects the domed distal surface 132 to form an outer edge 135 of the domed distal surface 132. The central bristle tuft 130 has a first height H1 at the outer edge 135 of the domed distal surface 132 and a maximum height at the apex 133. As shown in the figures, the first height H1 is measured from the front surface 123 of the head 120 to the outer edge 135 of the domed distal surface 132.

Each of the perimetric bristle tufts 160 extends from the front surface 123 of the head 120 to an inclined distal surface 165 that slopes downward towards the central bristle tuft 130. The inclined distal surfaces 165 slope downwardly in a direction from the lateral surface 125 of the head 120 towards the central bristle tuft 130. Thus, toothpaste slurry on the cleaning elements 115 will naturally flow downwards along the inclined distal surfaces 165 towards the central bristle tuft 130 due to the inclined sloping shape of the distal surfaces 165 of the perimetric bristle tufts 160.

For each of the perimetric bristle tufts 160, the inner sidewall 161 intersects the inclined distal surface 165 to form an inner edge 166 of the inclined distal surface 165 that faces the central bristle tuft 130 and the outer sidewall 162 intersects the inclined distal surface 165 to form an outer edge 167 of the inclined distal surface 165 that faces the lateral surface 125 of the head 120. Each of the perimetric bristle tufts 160 has a second height H2 at the inner edge 166 of the inclined distal surface 166 and a third height H3 at the outer edge 167 of the inclined distal surface 166. The second and third heights H2, H3 are measured from the front surface 123 of the head 120 to the inner and outer edges 166, 167 of the inclined distal surface 166, respectively. The third height H3 is greater than the second height H2 due to the inclined slope of the inclined distal surface 165.

In this embodiment, the first height H1 of the outer edge 135 of the domed distal surface 132 of the central bristle tuft 130 is greater than the second height H2 of the inner edge 166 of the inclined distal surface 165 of the perimetric bristle tuft 160. Furthermore, the third height H3 of the outer edge 167 of the inclined distal surface 165 of the perimetric bristle tuft 160 is greater than the first height H1 of the outer edge 135 of the domed distal surface 132 of the central bristle tuft 130. This is the case for each of the perimetric bristle tufts 160. Thus, in this embodiment the domed distal surface 132 of the central bristle tuft 130 is located entirely between: (1) a plane that is parallel to the front surface 123 of the head 120 and intersects the inner edge 166 of the inclined distal surface 165 of the perimetric bristle tufts 160; and (2) a plane that is parallel to the front surface 123 of the head 120 and intersects the outer edge 166 of the inclined distal surface 165 of the perimetric bristle tufts 160. In this embodiment, the central bristle tuft 130 has a maximum height at the apex 133 of the domed distal surface 132, the maximum height being greater than the second height H2 and less than the third height H3.

Thus, in this embodiment the domed distal surface 132 of the central bristle tuft 130 is located entirely in a location that is aligned with the inclined distal surface 165 of the perimetric bristle tufts 160. No part of the domed distal surface 132 of the central bristle tuft 130 is located below (i.e., closer to the front surface 123 of the head 120) the inclined distal surface 165 of the perimetric bristle tufts 160.

Figure 7:
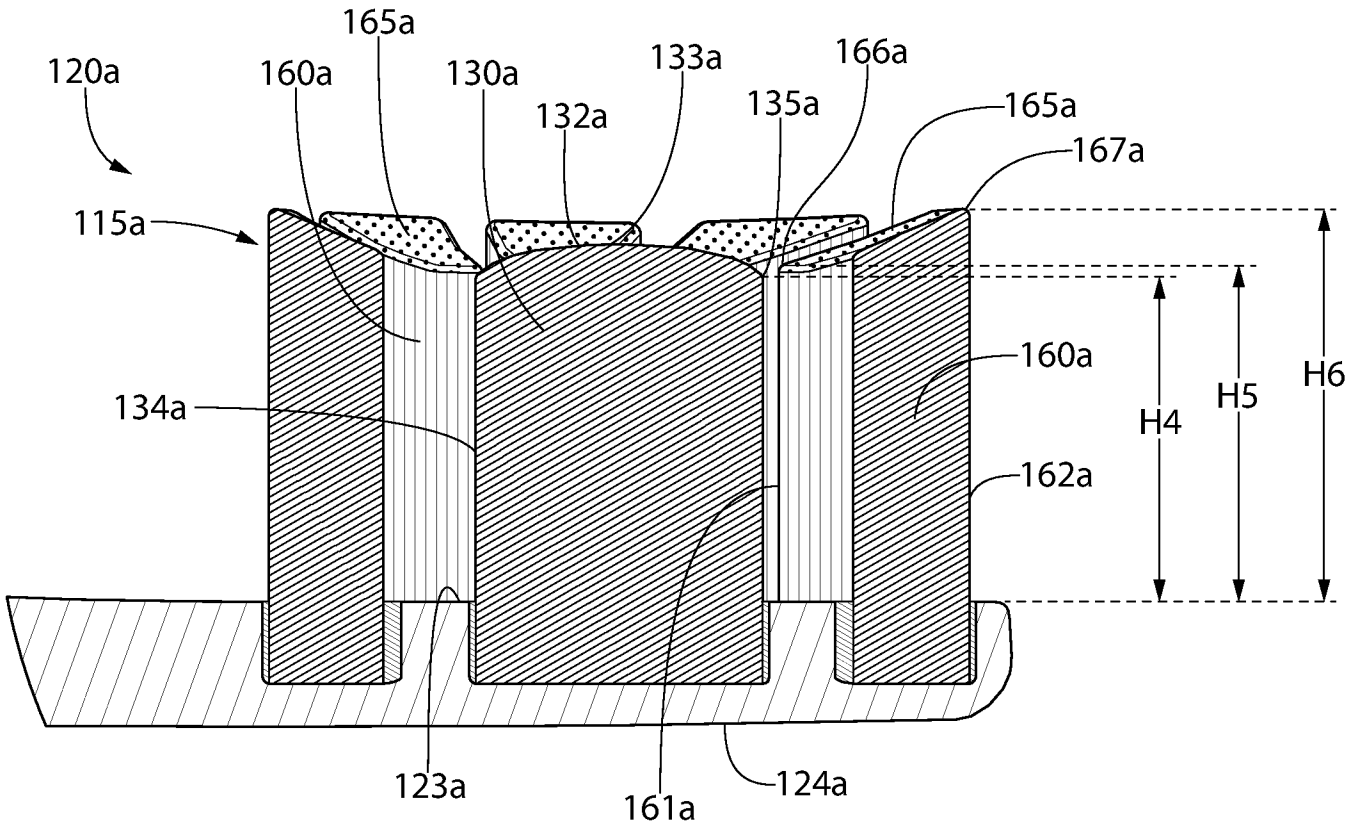
FIG. 7 is a cross-sectional view taken along line IV-IV of FIG. 3 in accordance with a first alternative embodiment of the present invention.
Figure 8:
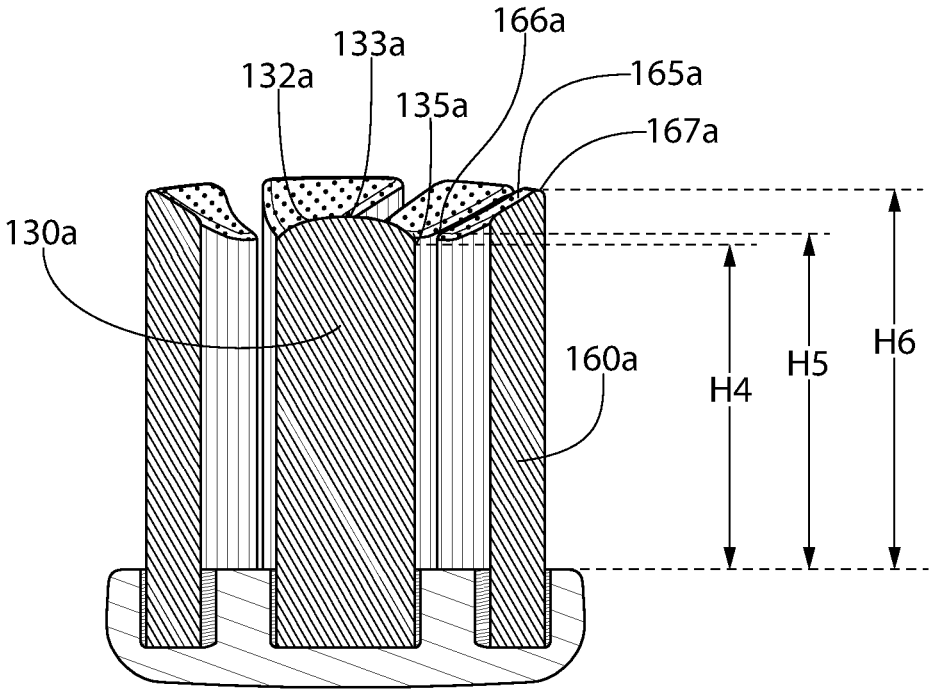
FIG. 8 is a cross-sectional view taken along line V-V of FIG. 3 in accordance with the first alternative embodiment of the present invention.

FIGS. 7 and 8 illustrate the head 120*a* of the oral care implement 100 of FIG. 1 in accordance with an alternative embodiment of the present invention. The above description is mostly applicable to FIGS. 7 and 8, and thus only the features that are different in these figures will be described in detail. Furthermore, for this embodiment the suffix "a" will be used for each reference numeral to distinguish the different embodiments from one another.

The head 120*a* comprises a front surface 123*a* and a rear surface 124*a* opposite the front surface 123*a*. Furthermore, a plurality of cleaning elements 115*a* are coupled to the head 120*a* and extend from the front surface 123*a* of the head 120*a*. The plurality of cleaning elements 115 comprise a central bristle tuft 130*a* and a plurality of perimetric bristle tufts 160*a*. The perimetric bristle tufts 160*a* are arranged to circumferentially surround the central bristle tuft 130*a*. In this embodiment, the cleaning elements 115*a* are coupled to the head using the PTt technology, which was described in detail above and therefore will not be repeated herein.

The central bristle tuft 130*a* has a domed distal surface 132*a* and a sidewall 134*a* that intersects the domed distal surface to form an outer edge 135*a* of the domed distal surface 132*a*. The central bristle tuft 130*a* has a fourth height H4 at the outer edge 135*a* of the domed distal surface 132*a*, the fourth height being measured from the front surface 123*a* of the head 120*a* to the outer edge 135*a*.

Each of the perimetric bristle tufts 160*a* has an inclined distal surface 165*a* that slopes downwardly towards the central bristle tuft 130*a*. Furthermore, each of the perimetric bristle tufts 160*a* comprises an inner sidewall 161*a* that intersects the inclined distal surface 165*a* to form an inner edge 166*a* of the inclined distal surface 165*a* and an outer sidewall 162*a* opposite the inner sidewall 161*a* that intersects the inclined distal surface 165*a* to form an outer edge 167*a* of the inclined distal surface 165*a*. The perimetric bristle tufts 160 have a fifth height H5 at the inner edge 166*a* of the inclined distal surface 165*a* and a sixth height H6 at the outer edge 167*a* of the inclined distal surface 165*a*, the fifth and sixth heights H5, H6 being measured from the front surface 123*a* of the head 120*a* to the inner and outer edges 166*a*, 167*a*. Due to the downward sloping incline of the inclined distal surface 165*a*, the sixth height H6 is greater than the fifth height H5

The main difference between this embodiment and the one previously described relates to the relative heights of the outer edge 135*a* of the domed distal surface 132*a* and the inner and outer edges 166*a*, 167*a* of the inclined distal surface 165*a* of the perimetric bristle tufts 160. Specifically, in this embodiment the fourth height H4 of the central bristle tuft 130*a* is less than the fifth height H5 of the perimetric bristle tufts 160*a* and the fifth height H5 of the perimetric bristle tufts 160*a* is less than the sixth height H6 of the perimetric bristle tufts 160*a*. Thus, the outer edge 135*a* of the domed distal surface 132 is positioned below a plane that is parallel to the front surface 123*a* of the head 120*a* that intersects the inner edge 166*a* of the inclined distal surface 165*a* of the perimetric bristle tufts 160*a*.

However, in this embodiment the central bristle tuft 130*a* has a maximum height measured at an apex 133*a* of the domed distal surface 132*a*. The maximum height of the central bristle tuft 130*a* is greater than the fifth height H5 and less than the sixth height H6. Thus, the apex 133*a* of the central bristle tuft 130*a* is located between: (1) a plane that is parallel to the front surface 123*a* of the head 120*a* and intersects the inner edge 166*a* of the inclined distal surface 165*a* of the perimetric bristle tufts 160*a*, and (2) a plane that is parallel to the front surface 123*a* of the head 120*a* and intersects the outer edge 167*a* of the inclined distal surface 165*a* of the perimetric bristle tufts 160*a*. Thus, in this embodiment the outer edge 135*a* of the domed distal surface 132*a* of the central bristle tuft 130*a* is located below the inner and outer edges 166*a*, 167*a* of the inclined distal surface 165*a* of the perimetric bristle tufts 160*a* (i.e., between the inner edge 166*a* and the front surface 123*a* of the head 120*a*) and the apex 133*a* of the domed distal surface 132*a* of the central bristle tuft 130*a* is located between the inner and outer edges 166*a*, 167*a* of the inclined distal surface 165*a* of the perimetric bristle tufts 160*a*.

Figure 9:
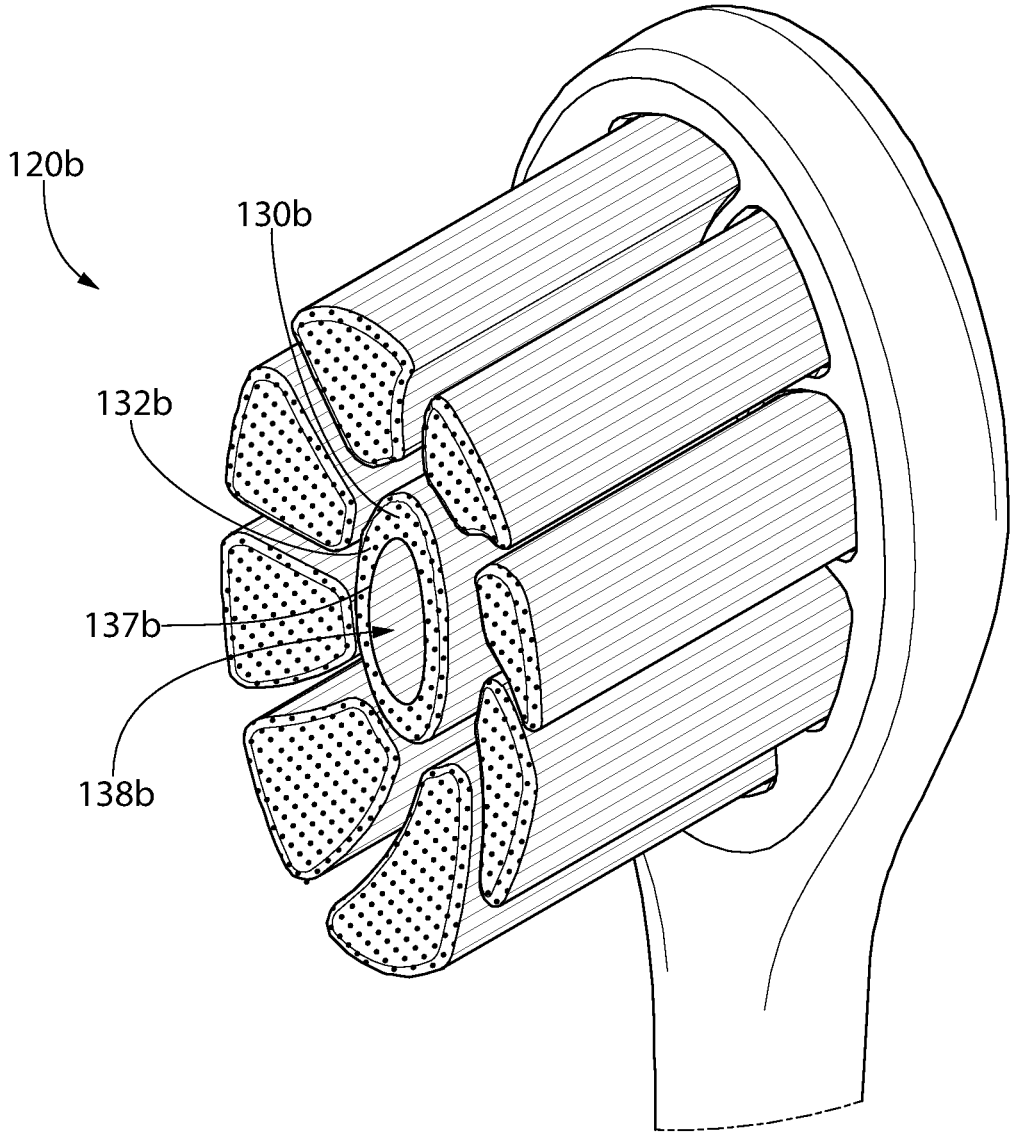
FIG. 9 is a close-up perspective view of a head of an oral care implement in accordance with a second alternative embodiment of the present invention.
Figure 10:
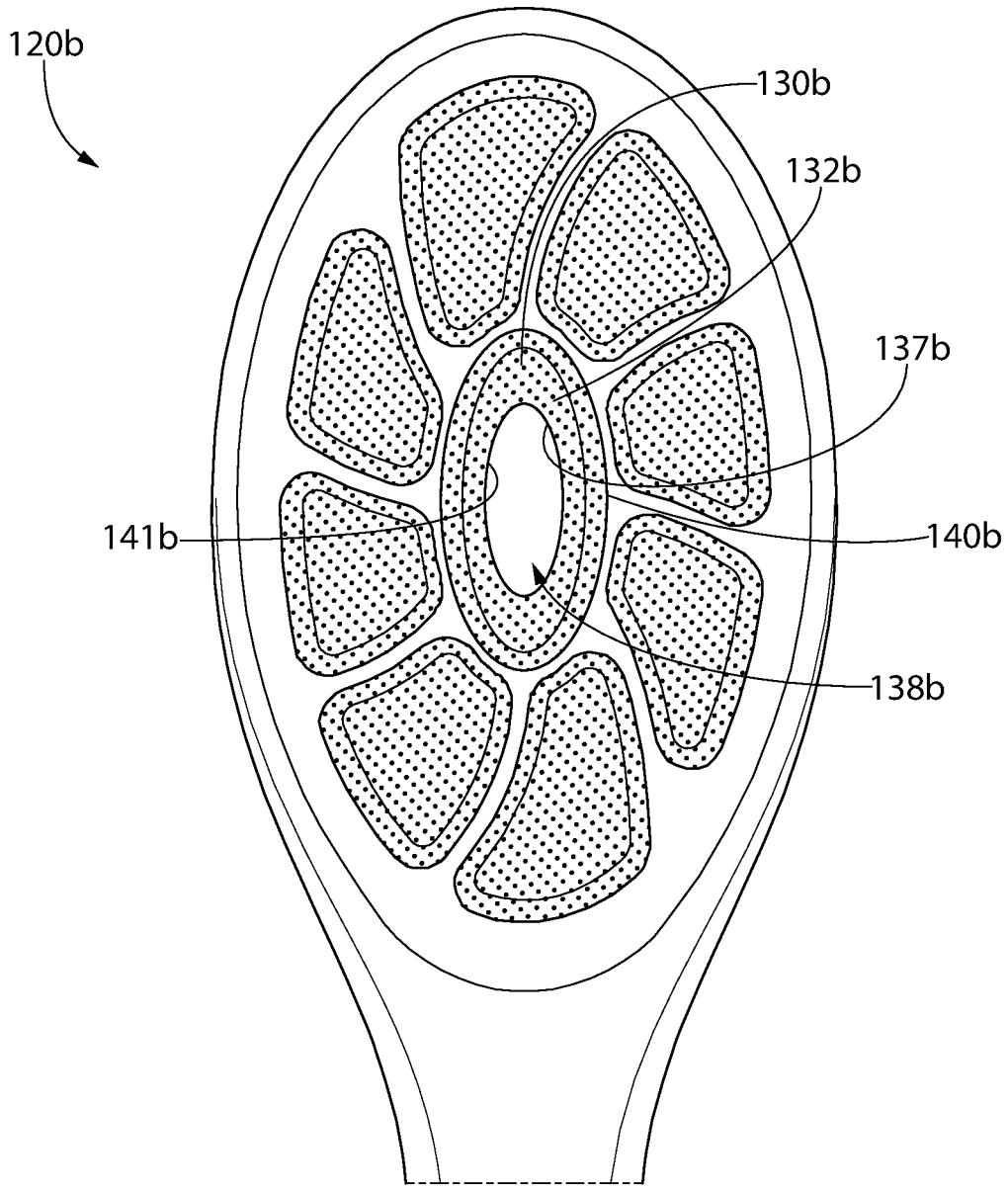
FIG. 10 is a close-up front view of the head of FIG. 9

FIGS. 9 and 10 illustrate the head 120*b* of the oral care implement 100 of FIG. 1 in accordance with another alternative embodiment of the present invention. The above description is mostly applicable to FIGS. 9 and 10, and thus only the features that are different in these figures will be described in detail. Furthermore, for this embodiment the suffix "b" will be used for each reference numeral to distinguish the different embodiments from one another.

The head 120*b* is identical to the head 120 described above with reference to FIGS. 1-6 except that the domed distal surface 132*b* of the central bristle tuft 130*b* is not an uninterrupted surface free of a central opening in this embodiment. Rather, in this embodiment the domed distal surface 132*b* of the central bristle tuft 130*b* comprises a central opening 137*b* that provides a passageway into a cavity 138*b* that is defined by the central bristle tuft 130*b*. Thus, the central bristle tuft 130*b* comprises an outer surface 140*b* as well as an inner surface 141*b*, the inner surface 141*b* surrounding and thereby defining the cavity 138*b*.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An oral care implement comprising:

a head comprising a front surface, a rear surface, an outer edge extending between the front and rear surfaces, a proximal end, a distal end, and a longitudinal axis extending from the proximal end to the distal end;

a central bristle tuft extending from the front surface of the head; and a plurality of perimetric bristle tufts extending from the front surface of the head and arranged to circumferentially surround the central bristle tuft, wherein each of the plurality of perimetric bristle tufts comprises:

an inner sidewall that is adjacent to the central bristle tuft;

an outer sidewall that is adjacent to the outer edge of the head;

a first-side sidewall extending between the inner and outer sidewalls, the first-side sidewall being convex; and a second-side sidewall extending between the inner and outer sidewalls, the second-side sidewall being concave, each of the plurality of perimetric bristle tufts having a bristle tuft width measured between the first-side sidewall and the second-side sidewall; and wherein adjacent ones of the perimetric bristle tufts are spaced apart by a gap having a gap width measured between the first-side and second-side sidewalls of the adjacent ones of the perimetric bristle tufts, and wherein the bristle tuft width of each of the plurality of perimetric bristle tufts is greater than the gap width of each of the gaps, and wherein the bristle tuft width increases with distance from the central bristle tuft;

wherein the central bristle tuft has a first height and wherein each of the plurality of perimetric bristle tufts has a second height measured along the inner sidewall and a third height measured along the outer sidewall, and wherein the first height is greater than the second height and less than the third height; and wherein the longitudinal axis intersects the second-side sidewall and the outer sidewall of two of the perimetric bristle tufts without intersecting the first-side sidewall and the inner sidewall of the two of the perimetric bristle tufts.

2. The oral care implement according to claim 1 wherein for each of the plurality of perimetric bristle tufts, the outer sidewall has a greater length than the inner sidewall, the inner sidewall is planar or concave, and the outer sidewall is planar or convex.

3. The oral care implement according to claim 2, wherein the outer sidewall of at least one of the plurality of perimetric bristle tufts is convex and wherein the inner sidewall of at least one of the plurality of perimetric bristle tufts is concave.

4. The oral care implement according to claim 1 wherein none of the plurality of perimetric bristle tufts is symmetric about an axis that intersects the inner and outer sidewalls of the perimetric bristle tuft.

5. The oral care implement according to claim 1 wherein the central bristle tuft is an oval that is elongated in a direction of the longitudinal axis and comprises a plurality of filament bristles.

6. The oral care implement according to claim 1 wherein each of the plurality of perimetric bristle tufts terminates in a distal end, and wherein the distal ends of each of the plurality of perimetric bristle tufts are sloped downwardly moving in a direction from the outer sidewall to the inner sidewall.

7. The oral care implement according to claim 1 wherein the central bristle tuft terminates in a dome shaped distal end.

8. The oral care implement according to claim 1 wherein the plurality of perimetric bristle tufts comprises at least three of the perimetric bristle tufts each having a different shape from one another.

9. The oral care implement according to claim 1 wherein the plurality of perimetric bristle tufts comprises at least three pairs of the perimetric bristle tufts, the perimetric bristle tufts of each pair having a same shape as each other and a different shape than the perimetric bristle tufts of each other pair.

10. The oral care implement according to claim 1 wherein for each of the plurality of perimetric bristle tufts the first-side sidewall faces in a counterclockwise direction and the second-side sidewall faces in a clockwise direction.

11. An oral care implement comprising:

a head comprising a front surface, a rear surface, an outer edge extending between the front and rear surfaces, a proximal end, a distal end, and a longitudinal axis extending from the proximal end to the distal end;

a plurality of bristle tufts extending from the front surface of the head, the plurality of bristle tufts consisting of:

a central bristle tuft;

a plurality of perimetric bristle tufts positioned around the central bristle tuft, each of the plurality of perimetric bristle tufts comprising an outer sidewall facing towards the outer edge of the head and having a first length and an inner sidewall facing towards the central bristle tuft and having a second length, the first length being greater than the second length, wherein each of the plurality of perimetric bristle tufts is non-symmetrical about any axis that intersects the outer and inner sidewalls of the perimetric bristle tuft; and wherein each of the plurality of perimetric bristle tufts comprises a concave sidewall extending between the inner and outer sidewalls and a convex sidewall extending between the inner and outer sidewalls opposite the concave sidewall, wherein the each of the plurality of perimetric bristle tufts has a bristle tuft width measured between the concave sidewall and the convex sidewall, the bristle tuft width increasing with distance from the central bristle tuft, and wherein the longitudinal axis intersects the concave sidewall and the outer sidewall of two of the perimetric bristle tufts without intersecting the convex sidewall and the inner sidewall of the two of the perimetric bristle tufts.

12. The oral care implement according to claim 11 wherein the head is oval in shape and is elongated in a direction of the longitudinal axis so that a length of the head measured between the proximal and distal ends is greater than a maximum width of the head measured in a direction transverse to the longitudinal axis, and wherein the central bristle tuft is oval in shape and is elongated in the direction of the longitudinal axis.

13. The oral care implement according to claim 11 wherein each of the plurality of perimetric bristle tufts comprises a third length which is a maximum length measured between the outer and inner sidewalls, wherein the third length of each of the plurality of perimetric bristle tufts is different from the third length of each adjacent one of the plurality of perimetric bristle tufts.

* * * * *